US009410105B2

(12) United States Patent
DeSantis et al.

(10) Patent No.: US 9,410,105 B2
(45) **Date of Patent: *Aug. 9, 2016**

(54) LUBRICANT COMPOSITIONS COMPRISING EPOXIDE COMPOUNDS

(71) Applicant: BASF SE

(72) Inventors: Kevin J. DeSantis, Upper Nyack, NY (US); Michael D. Hoey, Maplewood, NJ (US); Alfred Karl Jung, Carmel, NY (US); Phil Rabbat, Maplewood, NJ (US); Stephen Jones, Pomona, NY (US)

(73) Assignee: BASF SE, Ludwigshafen (DE)

( * ) Notice: Subject to any disclaimer, the term of this patent is extended or adjusted under 35 U.S.C. 154(b) by 0 days.

This patent is subject to a terminal disclaimer.

(21) Appl. No.: 14/081,360

(22) Filed: Nov. 15, 2013

(65) Prior Publication Data

US 2014/0142011 A1 May 22, 2014

Related U.S. Application Data

(60) Provisional application No. 61/727,414, filed on Nov. 16, 2012.

(51) Int. Cl.

| | |
|---|---|
| ***C10M 129/18*** | (2006.01) |
| ***C10M 129/68*** | (2006.01) |
| ***C10M 129/20*** | (2006.01) |
| ***C10M 133/38*** | (2006.01) |
| ***C10M 133/40*** | (2006.01) |
| ***C10M 133/58*** | (2006.01) |
| ***C10M 129/66*** | (2006.01) |
| ***C10M 133/06*** | (2006.01) |
| ***C10M 137/10*** | (2006.01) |
| ***C10M 129/56*** | (2006.01) |
| ***C10M 141/06*** | (2006.01) |
| ***C10M 149/10*** | (2006.01) |

(52) U.S. Cl.

CPC ..... *C10M 129/66* (2013.01); *C10M 129/18* (2013.01); *C10M 129/56* (2013.01); *C10M 133/06* (2013.01); *C10M 133/40* (2013.01); *C10M 137/10* (2013.01); *C10M 137/105* (2013.01); *C10M 141/06* (2013.01); *C10M 149/10* (2013.01); *C10M 2203/1006* (2013.01); *C10M 2203/1025* (2013.01); *C10M 2205/0285* (2013.01); *C10M 2207/042* (2013.01); *C10M 2207/24* (2013.01); *C10M 2215/04* (2013.01); *C10M 2215/221* (2013.01); *C10M 2215/28* (2013.01); *C10M 2223/045* (2013.01); *C10N 2220/021* (2013.01); *C10N 2220/028* (2013.01); *C10N 2230/36* (2013.01); *C10N 2230/42* (2013.01); *C10N 2230/52* (2013.01); *C10N 2240/10* (2013.01); *C10N 2270/02* (2013.01)

(58) Field of Classification Search

CPC ..... C10M 129/66; C10M 129/56; C10M 149/10; C10M 141/06; C10M 129/18; C10M 137/10; C10M 137/105; C10M 133/40; C10M 133/06; C10M 2215/04; C10M 2203/1025; C10M 2207/24; C10M 2215/28; C10M 2203/1006; C10M 2207/042; C10M 2215/221; C10M 2223/045; C10M 2205/0285; C10N 2270/02; C10N 2230/42; C10N 2220/021; C10N 2230/36; C10N 2240/10; C10N 2220/028; C10N 2230/52; C10N 2210/02; C10N 2220/022

USPC ..... 508/304, 243, 400, 577, 579, 262, 267

See application file for complete search history.

(56) References Cited

U.S. PATENT DOCUMENTS

| | | | | |
|---|---|---|---|---|
| 2,636,862 | A | | 4/1953 | Watson |
| 2,665,254 | A | | 1/1954 | Coppock |
| 2,684,943 | A | | 7/1954 | Baker |
| 2,734,032 | A | | 2/1956 | Coppock |
| 3,264,216 | A | | 8/1966 | Rockett |
| 3,619,423 | A | | 11/1971 | Galletti et al. |
| 3,637,507 | A | | 1/1972 | Gentit |
| 3,723,320 | A | | 3/1973 | Herber et al. |
| 3,769,221 | A | | 10/1973 | Burnous |
| 3,932,290 | A | | 1/1976 | Koch et al. |
| 3,941,708 | A | * | 3/1976 | Gentit et al. ..... 252/78.5 |
| 3,951,837 | A | | 4/1976 | Sheratte |
| 3,983,046 | A | | 9/1976 | Sheratte |
| 4,206,067 | A | * | 6/1980 | MacKinnon ..... 252/75 |
| 4,244,829 | A | | 1/1981 | Coupland et al. |
| 4,248,726 | A | | 2/1981 | Uchinuma et al. |
| 4,267,064 | A | | 5/1981 | Sasaki et al. |

(Continued)

FOREIGN PATENT DOCUMENTS

| | | | |
|---|---|---|---|
| CN | 102959065 | A | 3/2013 |
| EP | 0460309 | B1 | 8/1995 |

(Continued)

OTHER PUBLICATIONS

EIC Search Review Sep. 24, 2014.*

(Continued)

*Primary Examiner* — Pamela H Weiss

(74) *Attorney, Agent, or Firm* — Howard & Howard Attorneys PLLC

(57) ABSTRACT

A lubricant composition including an epoxide compound is disclosed. An additive package including the epoxide compound is also disclosed. The epoxide compound of the lubricant composition acts to improve compatibility of the lubricant composition with a fluoropolymer seal and improve the total base number of the lubricant composition.

10 Claims, No Drawings

(56) References Cited

U.S. PATENT DOCUMENTS 4,299,712 A 11/1981 Hoke
4,461,713 A 7/1984 Anzenberger, Sr.
4,504,403 A 3/1985 Tsunemi et al.
4,943,383 A 7/1990 Avery et al.
4,948,525 A 8/1990 Sasaki et al.
5,026,495 A 6/1991 Emert et al.
5,073,278 A * 12/1991 Schumacher et al. ..... 508/262
5,085,788 A 2/1992 Emert et al.
5,202,044 A 4/1993 Hagihara et al.
5,262,076 A 11/1993 Ishida et al.
5,279,752 A 1/1994 Hasegawa et al.
5,326,486 A 7/1994 Mizui et al.
5,346,737 A 9/1994 Takahashi et al.
5,366,646 A 11/1994 Sato et al.
5,370,809 A 12/1994 Ishida et al.
5,380,449 A 1/1995 Thomas et al.
5,407,591 A 4/1995 Emert et al.
5,443,745 A 8/1995 Sakamoto et al.
5,447,647 A 9/1995 Ishida et al.
5,454,963 A 10/1995 Kaneko
5,464,551 A * 11/1995 Deetman ..... 252/78.5
5,553,465 A 9/1996 Fukuda et al.
5,607,907 A * 3/1997 Watanabe et al. ..... 508/371
5,635,459 A 6/1997 Stoffa et al.
5,653,909 A 8/1997 Muraki et al.
5,720,895 A 2/1998 Nakagawa et al.
5,806,336 A 9/1998 Sunaga et al.
5,817,251 A 10/1998 Takigawa et al.
5,858,929 A 1/1999 Sumiejski et al.
5,955,519 A 9/1999 Neri
6,010,984 A 1/2000 Heimann et al.
6,028,038 A 2/2000 Kusch
6,060,437 A 5/2000 Robson et al.
6,090,869 A 7/2000 Orkin et al.
6,121,211 A * 9/2000 Stachew et al. ..... 508/304
6,153,118 A 11/2000 Hasegawa et al.
RE37,101 E * 3/2001 Deetman ..... 252/78.5
6,207,624 B1 * 3/2001 Stachew et al. ..... 508/290
6,221,274 B1 4/2001 Akahori et al.
6,228,282 B1 5/2001 Shimomura et al.
6,231,782 B1 5/2001 Shimomura et al.
6,235,687 B1 5/2001 Nadasdi et al.
6,245,836 B1 6/2001 Nakamaru et al.
6,316,392 B1 11/2001 Heimann et al.
6,319,423 B1 * 11/2001 Okazaki et al. ..... 252/78.5
6,355,186 B1 3/2002 Shimomura et al.
6,531,429 B2 3/2003 Fletschinger et al.
6,613,725 B1 9/2003 Tazaki
6,656,890 B1 12/2003 Fish et al.
6,692,654 B2 2/2004 Osumi et al.
6,703,355 B2 3/2004 Antika et al.
6,750,182 B1 6/2004 Nadasdi
6,759,372 B2 7/2004 Cotter
6,784,143 B2 8/2004 Locke et al.
6,831,045 B2 12/2004 Shimomura et al.
7,018,559 B2 3/2006 Zhang et al.
7,018,961 B2 3/2006 Tazaki
7,045,489 B2 5/2006 Cotter et al.
7,045,490 B2 5/2006 Shimomura et al.
7,052,626 B1 5/2006 Hasegawa et al.
7,341,984 B2 3/2008 Wilson et al.
7,419,940 B2 9/2008 Yoon et al.
7,429,554 B2 9/2008 Tipton et al.
7,579,306 B2 8/2009 Costello et al.
7,592,297 B2 9/2009 Adhvaryu
7,605,117 B2 10/2009 Wilson et al.
7,618,928 B2 11/2009 Stokes et al.
7,674,364 B2 3/2010 Loh et al.
7,708,903 B2 5/2010 Sievert et al.
7,718,586 B2 5/2010 Schield et al.
7,914,696 B2 3/2011 Low et al.
7,914,697 B2 3/2011 Kaneko
7,959,824 B2 6/2011 Tagawa et al.
7,981,270 B2 7/2011 Rosenbaum et al.
8,048,832 B2 11/2011 Rowland
8,070,978 B2 12/2011 Kaneko
8,097,181 B2 1/2012 Leck et al.
8,097,740 B2 1/2012 Miller
8,137,577 B2 3/2012 Kaneko et al.
8,153,565 B2 4/2012 Tipton et al.
8,158,564 B2 4/2012 Sato et al.
8,158,710 B2 4/2012 Vollenberg
8,183,187 B2 5/2012 Sumiejski et al.
8,193,129 B2 6/2012 Tagawa et al.
8,216,985 B2 7/2012 Mikami
8,227,387 B2 7/2012 Tagawa et al.
8,258,326 B1 9/2012 Forest et al.
8,287,754 B1 10/2012 Bredsguard et al.
8,318,041 B2 11/2012 Uebe et al.
8,383,004 B2 2/2013 Mouli et al.
8,404,867 B2 3/2013 Forest et al.
8,480,919 B2 7/2013 Kaneko et al.
8,486,873 B2 7/2013 McDougall
8,492,327 B2 7/2013 Singh et al.
8,512,591 B2 8/2013 Low
8,529,786 B2 9/2013 Leck et al.
8,535,555 B2 9/2013 Feiring et al.
8,535,556 B2 9/2013 Leck et al.
8,557,754 B2 10/2013 Singh et al.
8,603,354 B2 12/2013 Kaneko
8,628,681 B2 1/2014 Low
8,628,868 B2 1/2014 Burns et al.
8,648,022 B2 2/2014 Tazaki et al.
8,668,791 B2 3/2014 Leck et al.
8,673,169 B2 3/2014 Sato et al.
8,703,873 B2 4/2014 Sauer
8,715,522 B2 5/2014 Tokiai et al.
8,716,200 B2 5/2014 Seemeyer et al.
8,747,650 B2 6/2014 Van Leeuwen et al.
8,759,263 B2 6/2014 Kupper et al.
8,796,193 B2 8/2014 Tagawa et al.
8,815,114 B2 8/2014 Rao et al.
8,841,242 B2 9/2014 Kamano et al.
8,859,474 B2 10/2014 McDougall
8,859,658 B2 10/2014 Bredsguard et al.
8,894,875 B2 11/2014 Kaneko et al.
8,906,250 B2 12/2014 Kaneko et al.
8,926,857 B2 1/2015 Kaneko et al.
8,999,190 B2 4/2015 Low
9,074,115 B2 7/2015 Low
9,175,202 B2 11/2015 Low
9,175,203 B2 11/2015 Rached
9,187,683 B2 11/2015 Low
2005/0256014 A1 11/2005 Sherman et al.
2006/0128575 A1 6/2006 Geiger et al.
2006/0266976 A1 11/2006 Minor et al.
2008/0051306 A1 * 2/2008 Chasan et al. ..... 508/267
2008/0157023 A1 7/2008 Samuels et al.
2008/0216393 A1 9/2008 DuMont et al.
2008/0221000 A1 * 9/2008 Chase et al. ..... 508/262
2009/0298725 A1 12/2009 Zhang et al.
2009/0318316 A1 12/2009 Morishima
2009/0318317 A1 12/2009 Morishima
2009/0318320 A1 12/2009 Kaneko et al.
2010/0200799 A1 8/2010 Mouli
2010/0205980 A1 8/2010 Dixon et al.
2011/0005723 A1 1/2011 Mouli
2011/0015105 A1 * 1/2011 Davies et al. ..... 508/280
2011/0023531 A1 2/2011 Kaneko et al.
2011/0201531 A1 8/2011 Sharma et al.
2011/0239969 A1 10/2011 McDougall
2011/0258146 A1 10/2011 Low
2011/0287989 A1 11/2011 Filippini
2012/0126187 A1 5/2012 Low
2012/0187330 A1 7/2012 Singh et al.
2012/0228541 A1 9/2012 Takigawa et al.
2012/0258896 A1 10/2012 Aguilar et al.
2012/0305830 A1 12/2012 Low
2013/0032751 A1 2/2013 Low
2013/0087480 A1 4/2013 Stark et al.
2013/0119299 A1 5/2013 Low
2013/0187078 A1 7/2013 Low
2013/0193369 A1 8/2013 Low
2014/0020416 A1 1/2014 Feiring et al.

(56) References Cited

U.S. PATENT DOCUMENTS

| | | | |
|---|---|---|---|
| 2014/0038869 | A1 | 2/2014 | McDougall |
| 2014/0087983 | A1 | 3/2014 | Patil et al. |
| 2014/0093641 | A1 | 4/2014 | Minday et al. |
| 2014/0142008 | A1 | 5/2014 | DeSantis et al. |
| 2014/0142009 | A1 | 5/2014 | DeSantis et al. |
| 2014/0142010 | A1 | 5/2014 | DeSantis et al. |
| 2014/0142011 | A1 | 5/2014 | DeSantis et al. |
| 2014/0203190 | A1 | 7/2014 | Casasanta, III |
| 2014/0222699 | A1 | 8/2014 | Low |
| 2014/0245761 | A1 | 9/2014 | Dixon et al. |
| 2015/0014575 | A1 | 1/2015 | Saito et al. |
| 2015/0133353 | A1 | 5/2015 | Arai et al. |
| 2015/0152306 | A1 | 6/2015 | Rached |
| 2015/0184049 | A1 | 7/2015 | Nishiguchi et al. |
| 2015/0191673 | A1 | 7/2015 | DeSantis et al. |
| 2015/0240089 | A1 | 8/2015 | Mitsuoka et al. |
| 2015/0252281 | A1 | 9/2015 | Saito et al. |
| 2015/0291906 | A1 | 10/2015 | DeSantis et al. |
| 2015/0344761 | A1 | 12/2015 | Rached |

FOREIGN PATENT DOCUMENTS

| | | | | |
|---|---|---|---|---|
| JP | 10279882 | A | * | 10/1998 |
| JP | H 10-279882 | A | | 10/1998 |
| JP | 2000008069 | A | * | 1/2000 |
| WO | WO 90/05172 | A1 | | 5/1990 |
| WO | WO 92/17563 | A1 | | 10/1992 |
| WO | WO 93/10206 | A1 | | 5/1993 |
| WO | WO 97/32946 | A1 | | 9/1997 |
| WO | WO 02086011 | A1 | | 10/2002 |
| WO | WO 03/106601 | A1 | | 12/2003 |
| WO | WO 2004/029182 | A1 | | 4/2004 |
| WO | WO 2006/101019 | A1 | | 9/2006 |
| WO | WO 2007/053697 | A2 | | 5/2007 |
| WO | WO 2007/144623 | A1 | | 12/2007 |
| WO | WO 2007/148046 | A1 | | 12/2007 |
| WO | WO 2008/009922 | A3 | | 1/2008 |
| WO | WO 2008/009923 | A3 | | 1/2008 |
| WO | WO 2008/009928 | A3 | | 1/2008 |
| WO | WO 2008/027512 | A2 | | 3/2008 |
| WO | WO 2008/027519 | A1 | | 3/2008 |
| WO | WO 2008/027595 | A1 | | 3/2008 |
| WO | WO 2008/027596 | A3 | | 3/2008 |
| WO | WO 2008/0275513 | A2 | | 3/2008 |
| WO | WO 2008/136288 | A1 | | 11/2008 |
| WO | WO 2009/047535 | A3 | | 4/2009 |
| WO | WO 2010/029704 | A1 | | 3/2010 |
| WO | WO 2011/070141 | A2 | | 6/2011 |
| WO | WO 2011/161982 | A1 | | 12/2011 |
| WO | WO 2011161982 | A1 | * | 12/2011 |
| WO | WO2011161982 | A1 | | 12/2011 |
| WO | WO 2013/138123 | A1 | | 9/2013 |
| WO | WO 2013/141227 | A1 | | 9/2013 |
| WO | WO2013183676 | A1 | | 12/2013 |
| WO | WO 2014/009972 | A1 | | 1/2014 |
| WO | WO 2014/034568 | A1 | | 3/2014 |
| WO | WO 2014/072711 | A1 | | 5/2014 |
| WO | WO 2014/072712 | A1 | | 5/2014 |
| WO | WO 2014/072713 | A1 | | 5/2014 |
| WO | WO 2014/128442 | A3 | | 8/2014 |
| WO | WO 2014/161088 | A1 | | 10/2014 |
| WO | WO 2015/015188 | A1 | | 2/2015 |
| WO | WO 2015/152240 | A1 | | 10/2015 |
| WO | WO 2015/186670 | A1 | | 12/2015 |

OTHER PUBLICATIONS

EIC Search Review Sep. 25, 2014.*

English language abstract and translation for CN102959065 extracted from espacenet.com database on Mar. 27, 2014, 11 pages.

English language abstract for WO2011161982 extracted from espacenet.com database on Mar. 27, 2014, 17 pages. Also see English language translation equivalent CN102959065.

English language abstract for WO2013183676 extracted from espacenet.com database on Mar. 27, 2014, 36 pages.

International Search Report for Application No. PCT/US2013/070376 dated Apr. 3, 2014, 4 pages.

International Search Report for Application No. PCT/US2013/070388 dated Apr. 3, 2014, 4 pages.

International Search Report for Application No. PCT/US2013/070357 dated Apr. 2, 2014, 13 pages.

English language abstract and machine-assisted English translation for JPH 10-279882 extracted from espacenet.com Database on Jan. 31, 2016, 9 pages.

English language abstract of WO 03/106601and machine-assisted English translation for equivalent JP 2004-018531 extracted from espacenetcom database on Jan. 31, 2016, 26 pages.

English language abstract of WO 2004/029182 and machine-assisted English translation for equivalent JP 2004-115588 extracted from espacenetcom database on Jan. 31, 2016, 14 pages.

English language abstract of WO 2006/101019 and machine-assisted English translation for equivalent JP 2006-299220 extracted from espacenet.com database on Jan. 31, 2016, 40 pages.

English language abstract of WO 2008/136288 and machine-assisted English translation for equivalent JP 2010-159310 extracted from espacenet.com database on Jan. 31, 2016, 18 pages.

English language abstract of WO 2010/029704 and machine-assisted English translation for equivalent JP 2014-194030 extracted from espacenet.com database on Jan. 31, 2016, 14 pages.

English language abstract of WO 2011/161982 and machine-assisted English translation for equivalent KR 2013-0100964 extracted from espacenet.com database on Jan. 31, 2016, 18 pages.

English language abstract of WO 2013/141227 and machine-assisted English translation for equivalent JP 2013-196913 extracted from espacenet.com database on Jan. 31, 2016, 15 pages.

English language abstract for WO 2014/034568 extracted from espacenet.com database on Jan. 31, 2016, 1 page.

English language abstract and machine-assisted English translation for WO 2015/152240 extracted from espacenet.com database on Jan. 31, 2016, 20 pages.

English language abstract and machine-assisted English translation for WO 2015/186670 extracted from espacenet.com database on Jan. 31, 2016, 39 pages.

* cited by examiner

LUBRICANT COMPOSITIONS COMPRISING EPOXIDE COMPOUNDS

RELATED APPLICATIONS

This application claims priority to U.S. Provisional Patent Application No. 61/727,414, filed on Nov. 16, 2012, which is incorporated by reference herein in its entirety.

FIELD OF THE INVENTION

The present invention generally relates to a lubricant composition that includes a base oil and an epoxide compound. The invention also relates to an additive package for a lubricant composition and to a method of lubricating a system including a fluoropolymer seal.

BACKGROUND OF THE INVENTION

It is known and customary to add stabilizers to lubricant compositions based on mineral or synthetic oils in order to improve their performance characteristics. Some conventional amine compounds are effective stabilizers for lubricant compositions. These conventional amine compounds may help neutralize acids formed during the combustion process when the lubricant compositions are utilized in combustion engines. However, these conventional amine compounds are generally not employed in combustion engines due to their detrimental effects on fluoropolymer seals.

It is an object of the present invention to provide new types of lubricant compositions having improved fluoropolymer seal compatibility and improved neutralization.

SUMMARY OF THE INVENTION

The present invention provides a lubricant composition that includes a base oil and an additive package. The additive package includes an epoxide compound and an amine compound having a total base number of at least 80 mg KOH/g when tested according to ASTM D4739. The additive package is present in an amount of at least 5 wt. % based on a total weight of the lubricant composition. The lubricant composition includes less than 5 wt. % of an estolide compound based on a total weight of the lubricant composition.

The present invention is also directed to a lubricant composition that includes a base oil, an epoxide compound, and an amine compound having a total base number of at least 80 mg KOH/g when tested according to ASTM D4739. The lubricant composition has a total additive treat rate of at least 5 wt. % based on a total weight of the lubricant composition. The lubricant composition includes less than 5 wt. % of an estolide compound based on a total weight of the lubricant composition.

Furthermore, the present invention is directed to a lubricant composition that includes a base oil and an additive package. The additive package includes an epoxide compound and an amine compound. The amine compound is selected from the group of: a) a sterically hindered amine compound having the general formula (XIV) or (XV):

(XIV)

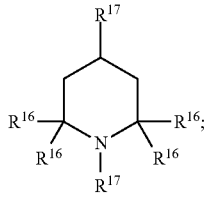

(XV)

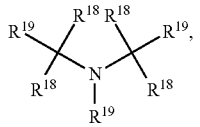

wherein each $R^{16}$ is independently a hydrogen atom or a hydrocarbyl group having from 1 to 17 carbon atoms; wherein at least two groups designated by $R^{16}$ are each an alkyl group; wherein each $R^{17}$ is independently a hydrogen atom or a hydrocarbyl group having from 1 to 17 carbon atoms; wherein each $R^{18}$ is independently a hydrogen atom or a hydrocarbyl group having from 1 to 17 carbon atoms; wherein at least two groups designated by $R^{18}$ are each an alkyl group; wherein each $R^{19}$ is independently a hydrogen atom or a hydrocarbyl group having from 1 to 17 carbon atoms; and wherein the hydrocarbyl groups designated by $R^{16}$, $R^{17}$, $R^{18}$, and $R^{19}$ are each independently and optionally substituted with an alcohol group, an amide group, an ether group, or an ester group; b) a monomeric aliphatic acyclic amine compound having a molecular weight of less than 500 and consisting of covalent bonds; c) a monomeric aliphatic cyclic amine compound having a molecular weight of less than 500 and including no more than two nitrogen atoms; and d) combinations thereof. The lubricant composition includes less than 5 wt. % of an estolide compound based on a total weight of the lubricant composition. The additive package is present in an amount of at least 5 wt. % based on a total weight of the lubricant composition.

The present invention is also directed to a method of lubricating a system that includes a fluoropolymer seal. The method includes providing a lubricant composition that includes a base oil and an additive package. The method includes contacting the fluoropolymer seal with the lubricant composition. The additive package includes an epoxide compound and an amine compound. The additive package is present in an amount of at least 5 wt. % based on a total weight of the lubricant composition. The amine compound has a total base number of at least 80 mg KOH/g when tested according to ASTM D4739. The lubricant composition includes less than 5 wt. % of an estolide compound based on a total weight of the lubricant composition.

The present invention is also directed to an additive package for a lubricant composition. The additive package includes an epoxide compound and an amine compound having a having a total base number of at least 80 mg KOH/g when tested according to ASTM D4739.

Lubricant compositions including the epoxide compound demonstrate improved compatibility with fluoropolymer seals as demonstrated by CEC L-39-T96 and improved neutralization ability as demonstrated by ASTM D4739 and ASTM D2896.

DETAILED DESCRIPTION

The lubricant composition or additive package includes at least one epoxide compound. In some embodiments, the epoxide compound may be represented by general formula (I):

(I)

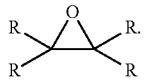

In general formula (I), each R is independently a hydrogen atom or a hydrocarbyl group. Multiple groups designated by R may be bonded together to form a cyclic structure.

The term "cyclic" is intended to refer to compounds that include any molecules having at least three atoms joined together to form a ring. In some embodiments, the term "cyclic" does not include aromatic compounds.

The epoxide compound may include one or more oxirane ring. The oxirane ring may be a terminal oxirane ring or an internal oxirane ring. The term "terminal oxirane ring" means that one of the carbon atoms which form the oxirane ring must contain two hydrogen atoms, or that two carbons which form the oxirane ring also form part of a cyclic ring. The term "internal oxirane ring" means that neither of the carbon atoms which form the oxirane ring is bonded to more than one hydrogen atom. The epoxide compound may be free from internal oxirane rings, or may include fewer than 4, 3, 2, or 1, internal oxirane rings. Alternatively, the epoxide compound may include 1, 2, 3, 4, or more internal oxirane rings. Alternatively still, the epoxide compound may include at least 1, at least 2, at least 3, at least 4 terminal oxirane rings. In certain embodiments, at least one, or at least two, oxirane rings may be terminal and may be cyclic, i.e, the carbons of the oxirane rings are part of a cyclic ring.

Each hydrocarbyl group designated by R may independently be substituted or unsubstituted, straight or branched, alkyl, alkenyl, cycloalkyl, cycloalkenyl, aryl, alkylaryl, arylalkyl group, or combinations thereof. Each hydrocarbyl group designated by R may independently include from 1 to 100, 1 to 50, 1 to 40, 1 to 30, 1 to 20, 1 to 15, 1 to 10, 1 to 6, or 1 to 4, carbon atoms. Alternatively, each hydrocarbyl group designated by R may independently include less than 20, less than 15, less than 12, or less than 10, carbon atoms.

By "unsubstituted," it is intended that the designated hydrocarbyl group or hydrocarbon group is free from substituent functional groups, such as alkoxy, amide, amine, keto, hydroxyl, carboxyl, oxide, thio, and/or thiol groups, and that the designated hydrocarbyl group or hydrocarbon group is free from heteroatoms and/or heterogroups.

Alternatively, each hydrocarbyl group designated by R may be independently substituted, and include one or more heteroatoms, such as oxygen, nitrogen, sulfur, chlorine, fluorine, bromine, or iodine, and/or one or more heterogroups, such as pyridyl, furyl, thienyl, and imidazolyl. Alternatively, or in addition to including heteroatoms and heterogroups, each hydrocarbyl group designated by R may independently include one or more substituent groups selected from alkoxy, amide, amine, carboxyl, epoxy, ester, ether, hydroxyl, keto, metal salt, sulfuryl, and thiol groups. Alternatively, each hydrocarbyl group designated by R may be independently unsubstituted.

Exemplary alkyl groups include methyl, ethyl, propyl, isopropyl, n-butyl, isobutyl, sec-butyl, tert-butyl, pentyl, isoamyl, hexyl, 2-ethylhexyl, octyl and dodecyl groups. Exemplary cycloalkyl groups cyclopropyl, cyclopentyl and cyclohexyl groups. Exemplary aryl groups include phenyl and naphthalenyl groups. Exemplary arylalkyl groups include benzyl, phenylethyl, and (2-naphthyl)-methyl.

As described above with respect to general formula (I), the hydrocarbyl group designated by R may include one or more epoxy groups. These hydrocarbyl epoxy groups may be represented by the general formula (II):

(II)

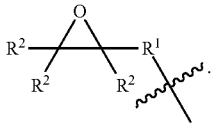

In general formula (II), $R^1$ is a divalent hydrocarbon group and each $R^2$ may independently be a hydrogen atom or a hydrocarbyl group. The divalent hydrocarbon group designated by $R^1$ may be substituted or unsubstituted, straight or branched, alkyl, alkenyl, cycloalkyl, cycloalkenyl, aryl, alkylaryl, arylalkyl group, or combinations thereof. Each hydrocarbon group designated by $R^1$ may independently include from 1 to 100, 1 to 50, 1 to 40, 1 to 30, 1 to 20, 1 to 15, 1 to 10, 1 to 6, or 1 to 4, carbon atoms. Alternatively still, each hydrocarbyl group designated by $R^1$ may independently include less than 20, less than 15, less than 12, or less than 10, carbon atoms. Alternatively, each hydrocarbon group designated by $R^1$ may be independently substituted, and include one or more heteroatoms, such as oxygen, nitrogen, sulfur, chlorine, fluorine, bromine, or iodine, and/or one or more heterogroups, such as pyridyl, furyl, thienyl, and imidazolyl. Alternatively, or in addition to including heteroatoms and heterogroups, each hydrocarbon group designated by $R^1$ may independently include one or more substituent groups selected from alkoxy, amide, amine, carboxyl, epoxy, ester, ether, hydroxyl, keto, metal salt, sulfuryl, and thiol groups. The hydrocarbyl groups designated by $R^2$ may have the same meaning as R as described above with respect to general formula (I). Multiple groups designated by $R^2$ may be bonded together to form a cyclic structure.

Referring again to general formula (I), if at least one R is a hydrocarbyl group including an amide group, exemplary epoxide compounds include N-methyl 2,3-epoxypropionamide, N-ethyl 2,3-epoxypropionamide, N-propyl 2,3-epoxypropionamide, N-isopropyl 2,3-epoxypropionamide, N-butyl 2,3-epoxypropionamide, N-isobutyl 2,3-epoxypropionamide, N-tert-butyl 2,3-epoxypropionamide, N-hexyl 2,3-epoxypropionamide, N-octyl 2,3-epoxypropionamide, N-(2-ethylhexyl)-2,3-epoxypropionamide, and N-dodecyl 2,3-epoxypropanionamide.

In certain embodiments, the epoxide compound of general formula (I) may be an alkyl epoxide compound. The alkyl epoxide compound may be exemplified by 1,2-epoxybutane, 2-methyl 2,3-epoxy butane, 1,2-epoxypentane, 1,2-epoxyhexane, 1,2-epoxyheptane, 1,2-epoxyoctane, 1,2-epoxynonane, 1,2-epoxydecane, 1,2-epoxyundecane, 1,2-epoxydodecane, 1,2-epoxytridecane, 1,2-epoxytetradecane, 1,2-epoxypentadecane, 1,2-epoxyhexadecane, 1,2-epoxyheptadecane, 1,1-,2-epoxyoctadecane, 1,2-epoxynonadecane, and 2,3-epoxy pentane.

Alternatively, in other embodiments, the epoxide compound of general formula (I) may be an alkyl glycidyl ether compound. The alkyl glycidyl ether compound may be exemplified by decyl glycidyl ether, undecyl glycidyl ether, dodecyl glycidyl ether, tridecyl glycidyl ether, tetradecyl glycidyl ether, 2-ethylhexyl glycidyl ether, neopentyl glycol diglycidyl ether, trimethylolpropane triglycidyl ether, pentaerythritol tetraglycidyl ether, 1,6-hexane diol diglycidyl ether, sorbitol polyglycidyl ether, polyalkylene glycol monoglycidyl ether, and polyalkylene glycol diglycidyl ether.

Exemplary epoxide compounds also include glycidol, glycidol derivatives, glycidyl, glycidyl derivatives, allyl 2,3-epoxypropyl ether, isopropyl 2,3-epoxypropyl ether, (tert-butoxymethyl)oxirane, and [[(2-ethylhexyl)oxy]methyl] oxirane.

In some embodiments, the epoxide compound may be an epoxide ester compound. The epoxide ester compound may be represented by general formula (III):

(III)

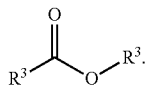

In general formula (III), each group designated by $R^3$ is independently a hydrogen atom or a hydrocarbyl group, and wherein at least one group designated by $R^3$ is an epoxy group or is a hydrocarbyl group substituted with an epoxy group. Alternatively, in certain embodiments, each group designated by $R^3$ is an epoxy group or a hydrocarbyl group substituted with at least one epoxy group. Further still, at least one of the groups designated by $R^3$ in general formula (III) may designate a cyclic hydrocarbyl group where two carbons of the oxirane ring are part of the cyclic ring. The hydrocarbyl groups designated by $R^3$ may independently have the same meaning as R described above with respect to general formula (I).

The epoxide ester compound of general formula (III) may be exemplified by methyl 2,3-epoxypropionate, ethyl 2,3-epoxypropionate, propyl 2,3-epoxypropionate, isopropyl 2,3-epoxypropionate, butyl 2,3-epoxypropionate, isobutyl 2,3-epoxypropionate, hexyl 2,3-epoxypropionate, octyl 2,3-epoxypropionate, 2-ethylhexyl 2,3-epoxypropionate, and dodecyl 2,3-epoxypropionoate.

In certain embodiments, the epoxide ester compound of general formula (III) may be more specifically represented by general formula (IV):

(IV)

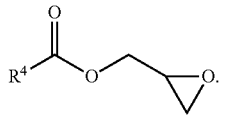

In general formula (IV), each group designated by $R^4$ may be a hydrogen atom or a hydrocarbyl group. The hydrocarbyl group designated by $R^4$ may have the same meaning as R described above with respect to general formula (I). The epoxide ester compound of general formula (IV) may be exemplified by glycidyl-2,2-dimethyl octanoate, glycidyl benzoate, glycidyl-tert-butyl benzoate, glycidyl acrylate, and glycidyl methacrylate.

In certain embodiments, the epoxide compound is a cyclic epoxide compound. The cyclic epoxide compound may be represented by general formula (V):

(V)

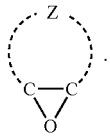

In general formula (V), Z represents the type and number of atoms necessary to complete the cyclic ring of general formula (V). The ring designated by Z may include from 2 to 20, 3 to 15, 5 to 15, carbon atoms. For example, the ring designated by Z may include 1, 2, 3, 4, 5, 6, 7, 8, 9, 10, 11, or 12 carbons, not accounting for the number of carbon atoms in any substituent groups. Z may be a substituted or unsubstituted, branched or unbranched, divalent hydrocarbon group that may include one or more heteroatoms, such as oxygen, nitrogen, sulfur, chlorine, fluorine, bromine, or iodine, or one or more heterogroups, such as pyridyl, furyl, thienyl, and imidazolyl. In addition to, or alternatively to, including heteroatoms and/or heterogroups, the ring designated by Z may include one or more hydrocarbyl substituent groups, such as those described for $R^1$ in general formula (I). The divalent hydrocarbon group designated by Z may be aliphatic or aromatic. In some embodiments, the divalent hydrocarbon group designated by Z may be exemplified by: cyclopropyl, cyclopentyl, cyclohexyl, phenyl, naphthalenyl, benzyl, phenylethyl, and (2-naphthyl)-methyl groups. It should be appreciated that the heteroatoms, heterogroups, and/or substituent groups described above may be bonded to various atoms in the ring designated by Z; for example, the hydrocarbyl substituent groups may be bonded directly to one or more carbons in the ring designated by Z that form part of the oxirane ring. Alternatively, the substituent groups, heterogroups, and heteroatoms may be bonded to other carbon atoms in the hydrocarbon group, such as carbons that are not part of the oxirane ring. In some embodiments, the cyclic epoxide compound of general formula (V) may be a cycloaliphatic epoxide compound having at least two terminal oxirane rings.

The cyclic epoxide compound of general formula (V) may be exemplified by 1,2-epoxycyclohexane, 1,2-epoxycyclopentane, 3,4-epoxycyclohexylmethyl-3,4-epoxycyclohexane carboxylate, bis(3,4-epoxy cyclohexylmethyl)adipate, bis(3,4-epoxy-6-methylcyclohexylmethyl)adipate, and 4-epoxyethyl-1,2-epoxycyclohexane.

As should be appreciated from general formulas (I), (II), (III), (IV), and (V) described above, the epoxide compound may be a monoepoxide, or a polyepoxide compound, such as a diepoxide. The polyepoxide compound includes at least two oxirane rings. Furthermore, in some embodiments, the polyepoxide compound may include fewer than 10, fewer than 8, fewer than 5, fewer than 4, or fewer than 3, oxirane rings per molecule.

The polyepoxide compound may include one or more substituted or unsubstituted, branched or unbranched, hydrocarbyl or divalent hydrocarbon groups, such alkyl, alkenyl, cycloalkyl, alkylcycloalkyl, aryl, alkylaryl group, arylalkyl groups, and combinations thereof. Each hydrocarbyl or divalent hydrocarbon group included in the polyepoxide compound may independently be substituted with one or more heteroatoms, such as oxygen, nitrogen, sulfur, chlorine, bromine, fluorine, or iodine, and/or may independently include one or more heterogroups, such as pyridyl, furyl, thienyl, and imidazolyl. Each hydrocarbyl or divalent hydrocarbon group in the polyepoxide compound may include one or more substituent groups selected from alkoxy, amide, amine, carboxyl, epoxy, ester, ether, hydroxyl, keto, metal salt, sulfuryl, and thiol groups. Each of the hydrocarbyl or divalent hydrocarbon groups in the polyepoxide compound may independently include from 1 to 100, 1 to 50, 1 to 40, 1 to 30, 1 to 20, 1 to 10, 1 to 6, or 1 to 4, carbon atoms. The hydrocarbyl or divalent hydrocarbon groups may be bonded to one another or to one or more carbon atoms of the oxirane rings to form the polyepoxide compound.

In some embodiments, the polyepoxide compound may be represented by the general formula (VI):

(VI)

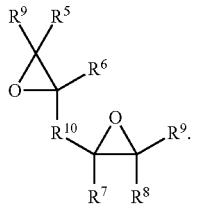

In general formula (VI), $R^5$, $R^6$, $R^7$, $R^8$ and $R^9$ are each independently a hydrogen atom or a hydrocarbyl group. $R^{10}$ is a divalent hydrocarbon group. The hydrocarbyl groups designated by $R^5$, $R^6$, $R^7$, $R^8$, and $R^9$ in general formula (VI) may have the same meaning as described above with respect to R in general formula (I). The divalent hydrocarbon group designated by $R^{10}$ in general formula (VI) may have the same meaning as described above with respect to $R^1$ in general formula (II). In certain embodiments, $R^5$ and $R^6$, together with the two carbons of the oxirane ring, form a cyclic structure. In other embodiments, $R^7$ and $R^8$, together with the two carbons of the oxirane ring, form a cyclic structure. As such, the polyepoxide compound of general formula (VI) may include one, two, or more than two, cyclic rings. Furthermore, in certain embodiments, at least one, or at least two, of the oxirane oxygens in general formula (VI) is directly bonded to two cyclic carbons, i.e., carbons which form part of a cyclic ring.

Alternatively, the polyepoxide compound may be represented by general formula (VII) shown below:

(VII)

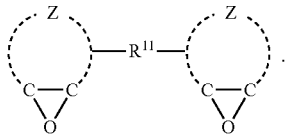

In general formula (VII), each Z may have the same meaning as described above with respect to general formula (V). In general formula (VII), $R^{11}$ is a divalent hydrocarbon group. $R^{11}$ may have the same meaning as described above with respect to $R^1$ in general formula (II). It should be appreciated that the divalent hydrocarbon group designated by $R^{11}$ may be bonded to various atoms in the divalent hydrocarbon group designated by Z. For example, the divalent hydrocarbon group designated by $R^{11}$ may be bonded directly to one or more oxirane ring carbons in certain embodiments. Alternatively, the divalent hydrocarbon group designated by $R^{11}$ may be bonded to non-oxirane ring carbon atoms in the hydrocarbon group designated by Z. The polyepoxide compound of general formula (VII) may be exemplified by:

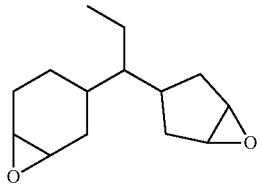

3-(1-(6-oxabicyclo[3.1.0]hexan-3-yl)propyl)-7-oxabicyclo[4.1.0]heptane

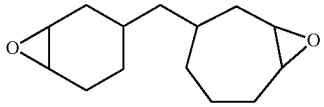

3-((7-oxabicyclo[4.1.0]heptan-3-yl)methyl)-8-oxabicyclo[5.1.0]octane

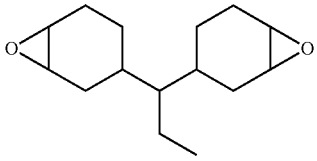

4-[1-(7-oxabicyclo[4.1.0]heptan-4-yl)propyl]-7-oxabicyclo[4.1.0]heptane

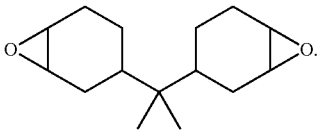

4-[1-methyl-1-(7-oxabicyclo[4.1.0]heptan-4-yl)ethyl]-7-oxabicyclo[4.1.0]heptane

In one specific embodiment, the polyepoxide compound may be a polyepoxide ester compound including at least two oxirane rings. In certain embodiments, the polyepoxide ester compound may be exemplified by the general formula (VIII):

(VIII)

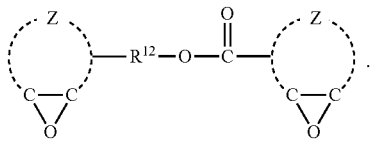

In general formula (VIII), each Z may have the same meaning as described above with respect to general formula (V). In general formula (VIII), $R^{12}$ is a divalent hydrocarbon group. $R^{12}$ may have the same meaning as described above with respect to $R^1$ in general formula (II). It should be appreciated that the divalent hydrocarbon group designated by $R^{12}$ may be bonded to various atoms in the divalent hydrocarbon group designated by Z. For example, the divalent hydrocarbon group designated by $R^{12}$ may be bonded directly to one or more oxirane ring carbons in certain embodiments. Alternatively, the divalent hydrocarbon group designated by $R^{12}$ may be bonded to non-oxirane ring carbon atoms in the ring designated by Z. In one embodiment, the epoxide compound of general formula (VIII) is a 3,4-epoxycycloalkyl, 3,4-epoxycycloalkyl carboxylate, such as 3,4-epoxycyclohexylmethyl, 3,4-epoxy-cyclohexane carboxylate. The polyepoxide ester compound of general formula (VIII) may be exemplified by:

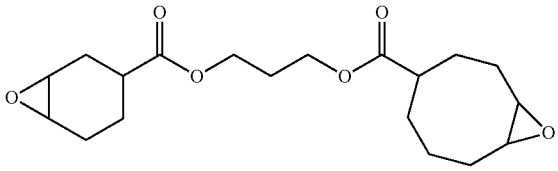

3-((7-oxabicyclo[4.1.0]heptane-3-carbonyl)oxy)propyl 9-oxabicyclo[6.1.0]nonane-4-carboxylate

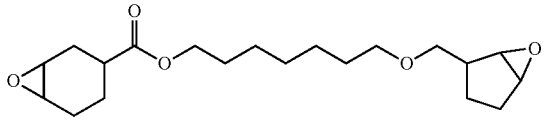

7-((6-oxabicyclo[3.1.0]hexan-2-yl)methoxy)heptyl 7-oxabicyclo[4.1.0]heptane-3-carboxylate

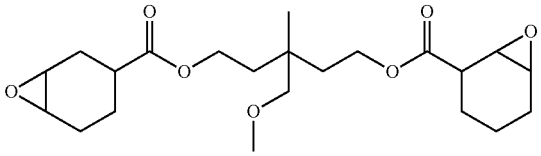

3-((7-oxabicyclo[4.1.0]heptane-3-carbonyl)oxy)-2-(methoxymethyl)-2-methylpropyl 7-oxabicyclo[4.1.0]heptane-2-carboxylate

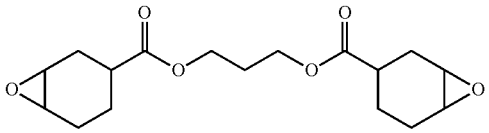

3-(7-oxabicyclo[4.1.0]heptane-4-carbonyloxy)propyl 7-oxabicyclo[4.1.0]heptane-4-carboxylate

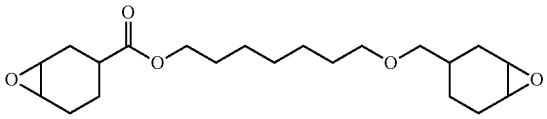

7-(7-oxabicyclo[4.1.0]heptan-4-ylmethoxy)heptyl 7-oxabicyclo[4.1.0]heptane-4-carboxylate

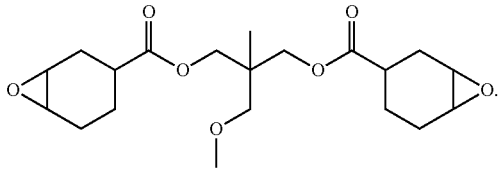

[2-(methoxymethyl)-2-methyl-3-(7-oxabicyclo[4.1.0]heptane-4-carbonyloxy)propyl] 7-oxabicyclo[4.1.0]heptane-4-carboxylate Alternatively still, the epoxide compound may be exemplified by general formula (IX):

$$[A]_w[B]_x \quad \text{(IX)}$$

In general formula (IX), each A is independently a hydrocarbyl group or a divalent hydrocarbon group and each B is an epoxy group. The group designated by A may have the same meaning as described above with respect to R in general formula (I) or $R^1$ in general formula (II). "w" is an integer having a value of from 0 to 50, and "x" is an integer having a value of from 0 to 10, where w+x≥1, and with the proviso that if x=0, at least one moiety designated by A is a hydrocarbyl group including an epoxy substituent group. "w" may be an integer having a value of from 1 to 40, 1 to 30, 1 to 20, 1 to 10, 1 to 8, 1 to 5, or 1 to 3, and "x" may be an integer having a value of 10, 9, 8, 7, 6, 5, 4, 3, 2, or 1. It should be appreciated that groups A and B in general formula (IX) may be bonded to one another in any order, with varying number of iterations.

The epoxide compound may be exemplified by the following compounds:

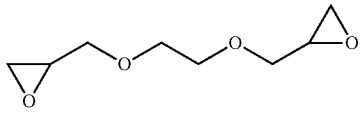

2,2′-[ethane-1,2-diylbis(oxymethanediyl)]dioxirane

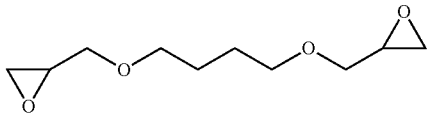

2,2′-[butane-1,4-diylbis(oxymethanediyl)]dioxirane

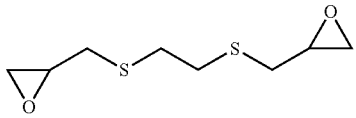

2,2′-[ethane-1,2-diylbis(sulfanediymethanediyl)]dioxirane

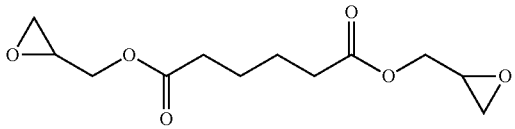

bis(oxiran-2-ylmethyl) hexanedioate

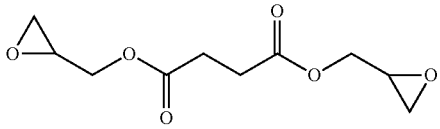

bis(oxiran-2-ylmethyl) butanedioate

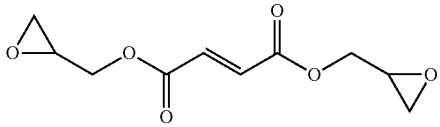

bis(oxiran-2-ylmethyl) (2*E*)-but-2-enedioate

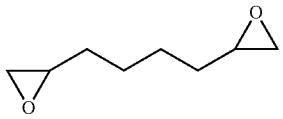

2,2′-butane-1,4-diyldioxirane

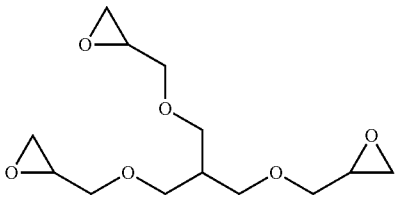

2,2′-[benzene-1,3-diylbis(oxymethanediyl)]dioxirane

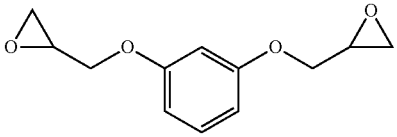

2-({3-(oxiran-2-ylmethoxy)-2-[(oxiran-2-ylmethoxy)methyl]propoxy}methyl)oxirane

-continued

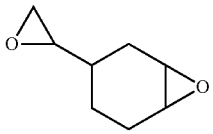

3-(oxiran-2-yl)-8-oxabicyclo[5.1.0]octane

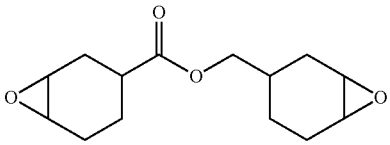

8-oxabicyclo[5.1.0]oct-3-ylmethyl 8-oxabicyclo[5.1.0]octane-3-carboxylate

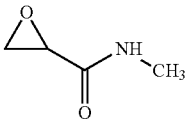

N-methyl 2,3-epoxypropionamide

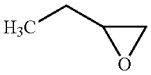

1,2-epoxybutane

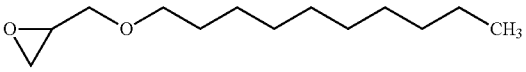

decyl glycidyl ether

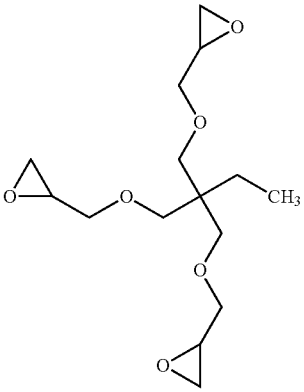

trimethylolpropane triglycidyl ether

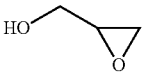

glycidol

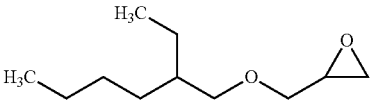

[[2-ethylhexyl)oxy]methyl]oxirane

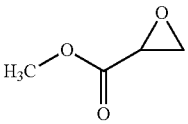

methyl 2,3-epoxypropionate

-continued

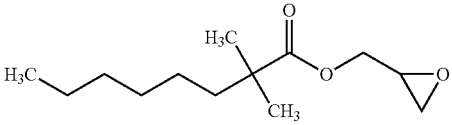

glycidyl-2,2-dimethyl octanoate

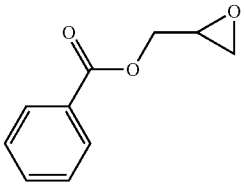

glycidyl benzoate

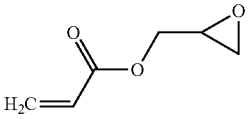

glycidyl acrylate

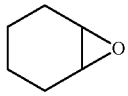

1,2-epoxycyclohexane

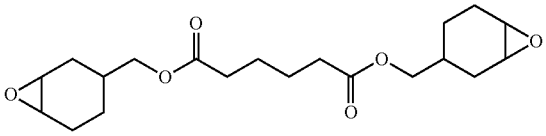

bis(3,4-epoxy cyclohexylmethyl) adipate

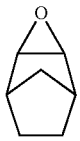

exo-2,3-epoxynorbornane

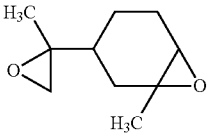

4-(1′-methylepoxyethyl)-1,2-epoxy-2-methylcyclohexane

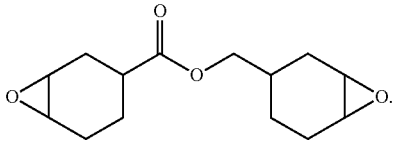

3,4-epoxycyclohexymethyl, 3,4-epoxy-cyclohexane carboxylate

It should be appreciated that all of these exemplary compounds fall within the scope of one or more of the general formulas (I), (III), (IV), (V), (VI), (VII), (VIII), and (IX) and/or within the scope of the written description of the epoxide compound herein.

In certain embodiments, the epoxide compound may be free from nitrogen, sulfur, phosphorous, chlorine, bromine, and/or iodine atoms. As described above, the epoxide compound may be aliphatic, cyclic, acyclic, and/or aromatic.

The epoxide compound may have a weight average molecular weight of from 44 to 1000, 50 to 750, 100 to 500, 100 to 400, or 100 to 200. Alternatively still, the epoxide compound may have a weight average molecular weight of at least 30, at least 50, at least 70, at least 90, at least 110, or at least 130. Alternatively, the epoxide compound may have a weight average molecular weight of less than 1500, less than 1300, less than 1100, less than 900, less than 700, less than 500, less than 400, or less than 300.

The epoxide compound may have an epoxide equivalent weight of from 75 to 300, 75 to 250, 75 to 200, 85 to 190, 85 to 175, 95 to 160, or 100 to 145, g per mole of oxirane ring of the epoxide compound. Alternatively, the epoxide compound may have an epoxide equivalent weight of at least 50, 60, 70, 80, 90, 100, 110, 120, 130, 140, or 150, g per mole of oxirane ring of the epoxide compound. As referred to throughout this disclosure, the term "epoxide equivalent weight" is the numerical value which is obtained by dividing the weight average molecular weight of the epoxide compound by the number of oxirane rings in the molecule.

The basicity effect of the epoxide compound can be determined by acid titration. The resulting neutralization number is expressed as the total base number (TBN), and can be measured using various methods. ASTM D4739 is a potentiometric hydrochloric acid titration. The ASTM D4739 method is favored in engine tests and with used oils to measure TBN depletion/retention. When testing used engine lubricants, it should be recognized that certain weak bases are the result of the service rather than having been built into the oil. This test method can be used to indicate relative changes that occur in lubricant composition during use under oxidizing or other service conditions regardless of the color or other properties of the resulting lubricant composition.

In some embodiments, the epoxide compound does not negatively affect the total base number of the lubricant composition. Alternatively, the epoxide compound may improve the TBN of the lubricant composition by, at 0.5, 1, 1.5, 2, 2.5, 3, 3.5, 4, 4.5, 5, 10, or 15, mg KOH/g of epoxide compound. The TBN value of the lubricant composition can be determined according to ASTM D2896 and/or ASTM D4739 as will be described below.

In certain embodiments, the epoxide compound is monomeric. The term "monomeric" is intended to indicate that the subject compound does not include more than three, more than two, or more than one, repeating monomer units bonded to one another. Alternatively, the term monomeric may refer to compounds that do not include any repeating monomer units. In other words, the term "monomeric" is intended to exclude compounds which are either oligomeric or polymeric. In certain embodiments, the monomeric epoxide compound excludes oils or alkyl fatty acid esters which have been epoxidized to include one or more oxirane rings, such as epoxidized vegetable oils. Alternatively, the lubricant composition or additive package may include less than 5, 4, 3, 2, 1, 0.5, 0.1, or 0.01, wt. %, of an epoxidized fatty acid ester or epoxidized oil based on a total weight of the lubricant composition. As used herein, the term "epoxidized oil" refers to a natural oil which was epoxidized to include at least 1, at least 2, at least 3, at least 4, at least 5, at least 6, at least 7, at least 8, or at least 9, epoxide groups per molecule and/or has an epoxide equivalent weight of greater than 200, 250, 300, or 350. As used herein, the term "epoxidized fatty acid ester" refers to a natural fatty acid ester or acid that includes at least 1, at least 2, at least 3, at least 4, at least 5, at least 6, at least 7, at least 8, or at least 9, epoxide groups per molecule and/or has a epoxide equivalent weight of greater than 200, 250, 300, or 350. As used herein, the term "natural" refers to compounds which are naturally-occurring.

The epoxide compound may have a boiling point of at least 50, 60, 70, 80, 90, 100, 110, 120, 130, 140, or 150, ° C., at 1 atmosphere of pressure. Alternatively, the epoxide compound has a boiling point of from 50 to 450, 55 to 450, 65 to 450, 75 to 450, 85 to 450, 100 to 450, 115 to 450, 125 to 450, 135 to 450, 150 to 450, or from 200 to 400, ° C., at 1 atmosphere of pressure. Furthermore, in certain embodiments, the epoxide compound is a liquid at a steady state temperature of 50° C. and a steady state pressure of 1 atmosphere of pressure.

The epoxide compound may have a flash point of from 25 to 250, 50 to 250, 65 to 250, 75 to 250, 100 to 250, or from 115 to 250, ° C. at 1 atmosphere of pressure. Alternatively, the epoxide compound may have a flash point of at least 25, 35, 45, 55, 65, 75, 85, 95, 105, 115, 125, or 135, ° C. at 1 atmosphere of pressure.

The amount of the epoxide compound included in the lubricant composition ranges from 0.01 to 8, 0.05 to 5, 0.1 to 2, 0.1 to 1.5, 0.3 to 1.2, 0.4 to 1, 0.1 to 1, 0.1 to 0.8, or 0.2 to 0.7, wt. %, based on the total weight of the lubricant composition. The epoxide compound may be included in the additive package in an amount of from 0.5 to 90, 1 to 50, 1 to 30, or 5 to 25, wt. %, based on the total weight of the additive package. The lubricant composition and/or additive package may include mixtures of two or more different epoxide compounds.

In certain embodiments, the epoxide compound is included in the lubricant composition in an amount sufficient to provide from 0.01 to 5, 0.01 to 4.5, 0.01 to 4, 0.01 to 3.5, 0.01 to 3, 0.01 to 2.5, 0.01 to 2, 0.01 to 1.5, 0.01 to 1, 0.1 to 0.9, 0.2 to 0.8, or 0.3 to 0.7, wt. % of oxirane oxygen, based on total weight of the lubricant composition.

The epoxide compound may be prepared using various methods as will be appreciated by one of ordinary skill in the art. For example, the epoxide compound may be prepared by the epoxidation of an allyl ether, α,β-unsaturated amide to the corresponding glycidyl ether, glycidic ester, or glycidic amide. Alternatively, an olefin may be epoxidized with hydrogen peroxide and an organic peracid to produce the epoxide compound. Alternatively, the olefin can be epoxidized in the presence of a transition metal catalyst and a co-oxidant to form the epoxide compound. Suitable co-oxidants include hydrogen peroxide, tert-butyl hydroperoxide, iodosylbenzene, sodium hypocholorite, and the like. Alternatively, glycidic esters may be prepared by Darzens condensation of an α-halo ester and an aldehyde or ketone, in the presence of a base.

In some embodiments, the lubricant composition and/or additive package is free of, or contains less than 5, 3, 1, 0.5, 0.1, or 0.05, wt. % of an epoxide reaction catalyst, based on the total weight of the lubricant composition. The epoxide reaction catalyst may be a metal salt, such as a metallic salt of fatty acids, naphthenates, phenolates, alcoholates, carboxylates, and the corresponding thio analogues, sulfonates, and sulphinates. The epoxide reaction catalyst may also refer to calcium cetyl alcoholate, barium isoamyl thiiphenolate, calcium naphthnate, and metal salts of alkyl substituted benzene sulphonic acid. In some embodiments, the epoxide reaction catalyst is defined as a component that catalyzes the reaction of the epoxide compound with an additional component in the lubricant composition at a temperature less than 100, 80, or, 60, ° C. The additional component may include, but is not limited to, any compound described in this specification other than the epoxide reaction catalyst and the epoxide compound. For example, the additional component referred to above may be a dispersant, an antiwear additive, an antioxidant, or a component that affects the total base number of the lubricant composition.

Conventional uses of epoxide compounds in lubricant compositions involve forming a reaction product between a conventional dispersant and a conventional epoxide compound. In these applications, the conventional epoxide compound is consumed by chemical reactions such that the ultimately formed lubricant composition does not contain appreciable amounts of the conventional epoxide compound in an unreacted state. The conventional epoxide compound may react via an addition reaction such that the addition of one or more small molecules to the lubricant composition may cause the epoxide group of the conventional epoxide compound to ring-open without eliminating or cleaving any part of the conventional epoxide compound.

In such conventional uses, more than 50 wt. % of the conventional epoxide compound is typically reacted with the conventional dispersants or other compounds based on the total weight of the conventional epoxide compound in the lubricant composition prior to the reaction. In contrast, the inventive lubricant compositions may contain a significant amount of the epoxide compound in an unreacted state. In certain embodiments, at least 50, 60, 70, 80 or, 90, wt. % of the epoxide compound remains unreacted in the lubricant composition based on a total weight of the epoxide compound utilized to form the lubricant composition prior to any reaction in the lubricant composition. Alternatively, at least 95, 96, 97, 98, or 99, wt. %, of the epoxide compound remains unreacted in the lubricant composition based on a total weight of the epoxide compound prior to any reaction in the lubricant composition.

The phrase "prior to any reaction in the lubricant composition" refers to the basis of the amount of the epoxide compound in the lubricant composition. This phrase does not require that the epoxide compound reacts with other components in the lubricant composition, i.e., 100 wt. % of the epoxide compound may remain unreacted in the lubricant composition based on a total weight of the epoxide compound prior to any reaction in the lubricant composition.

The percentage of the epoxide compound that remains unreacted is typically determined after all of the components which are present in the lubricant composition reach equilibrium with one another. The time period necessary to reach equilibrium in the lubricant composition may vary widely. For example, the amount of time necessary to reach equilibrium may range from a single minute to many days, or even weeks. The percentage of the epoxide compound that remains unreacted in the lubricant composition may be determined after 1 minute, 1 hour, 5 hours, 12 hours, 1 day, 2 days, 3 days, 1 week, 1 month, 6 months, or 1 year.

In certain embodiments, the lubricant composition includes less than 10, 5, 1, 0.5, 0.1, 0.01, 0.001, or 0.0001, wt. %, of compounds which would react with the epoxide compound at a temperature less than 150, less than 125, less than 100, or less than 80, ° C., based on a total weight of the lubricant composition. Exemplary types of compounds which may react with the epoxide compound at a temperature less than 100° C. include acids, amine curing agents, anyhydrides, triazoles, and/or oxides. In certain embodiments, the lubricant composition may include a collective amount of acids, amine curing agents, anhydrides, triazoles, and/or oxides which is less than 5, 3, 1, 0.5, or 0.1, wt. % based on a total weight of the lubricant composition. Alternatively, the lubricant composition may include a collective amount of acids, amine curing agents, anhydrides, triazoles, and/or oxides which is less than 0.01, 0.001, or 0.0001, wt. %, based on the total weight of the lubricant composition. Alternatively still, the lubricant composition may be free of acids, amine curing agents, anhydrides, triazoles, and/or oxides.

The term "acids" may include both traditional acids and Lewis acids. For example, acids include carboxylic acids, such as lactic acid and hydracylic acid; alkylated succinic acids; alkylaromatic sulfonic acids; and fatty acids. Exemplary Lewis acids include alkyl aluminates; alkyl titanates; molybdenumates, such as molybdenum thiocarbamates and molybdenum carbamates; and molybdenum sulfides.

Anhydrides are exemplified by alkylated succinic anhydrides and acrylates. Triazoles may be represented by benzotriazoles and derivatives thereof; tolutriazole and derivatives thereof; 2-mercaptobenzothiazole, 2,5-dimercaptothiadiazole, 4,4'-methylene-bis-benzotriazole, 4,5,6,7-tetrahydrobenzotriazole, and salts thereof. Oxides may be represented by alkylene oxides, such as ethylene oxide and propylene oxide; metal oxides; alkoxylated alcohols; alkoxylated amines; or alkoxylated esters.

In other conventional uses, conventional epoxide compounds undergo tribopolymerization in lubricant compositions to form protective lubricating films. In the tribopolymerization process, polymer-formers are adsorbed on a solid surface and polymerize under rubbing conditions to form organic polymeric films directly on the rubbing surface. In such conventional uses, more than 50 wt. % of the conventional epoxide compound is typically reacted via tribopolymerization. In contrast, the inventive lubricant compositions may contain a significant amount of the epoxide compound that does not react via tribopolymerization. In certain embodiments, at least 50, 60, 70, 80, or 90, wt. %, of the epoxide compound does not react via tribopolymerization in the lubricant composition at a temperature less than 100, 80, or 60, ° C., based on the total weight of epoxide compound utilized to form the lubricant composition. Alternatively, at least 95, 96, 97, 98, or 99, wt. %, of the epoxide compound does not react via tribopolymerization in the lubricant composition at a temperature less than 100, 80, or 60, ° C., based on a total weight of the epoxide compound in the lubricant composition.

As described above, the epoxide compound may be combined with at least one amine compound in the lubricant composition or additive package. It should be appreciated that mixtures of different amine compounds may also be combined with the epoxide compound in the lubricant composition and/or additive package. If utilized, the lubricant composition includes the amine compound in an amount of from 0.1 to 25, 0.1 to 20, 0.1 to 15, or 0.1 to 10, wt. %, based on the total weight of the lubricant composition. Alternatively, the lubricant composition may include the amine compound in an amount of from 0.5 to 5, 1 to 3, or 1 to 2, wt. %, based on the total weight of the lubricant composition.

The amine compound does not substantially react with the epoxide compound to form a salt. The absence of salt formation is evidenced by the lack of a chemical shift in the NMR spectra of the epoxide compound and the amine compound when they are combined in the lubricant composition and/or additive package. In other words, at least 50, 60, 70, 80, 90, 95, or 99, wt. %, of the amine compound remains unreacted after the lubricant composition and/or additive package reaches equilibrium.

In certain embodiments, the amine compound has a TBN value of at least 80 mg KOH/g when tested according to ASTM D4739. Alternatively, the amine compound has a TBN value of at least 90, at least 100, at least 110, at least 120, at least 130, at least 140, at least 150, or at least 160, mg KOH/g, when tested according to ASTM D4739. Alternatively still, the amine compound may have a TBN value of from 80 to 200, 90 to 190, 100 to 180, or 100 to 150, mg KOH g, when tested according to ASTM D4739.

In some embodiments, the amine compound does not negatively affect the total base number of the lubricant composition. Alternatively, the amine compound may improve the TBN of the lubricant composition by, at least 0.5, at least 1, at least 1.5, at least 2, at least 2.5, at least 3, at least 3.5, at least 4, at least 4.5, at least 5, at least 10, or at least 15, mg KOH/g of the amine compound. The TBN value of the lubricant composition can be determined according to ASTM D2896.

If the amine compound is included in the additive package, the additive package includes the amine compound in an amount of from 0.1 to 50 wt. %, based on the total weight of the additive package. Alternatively, the additive package may include the amine compound in an amount of from 1 to 25, 0.1 to 15, 1 to 10, 0.1 to 8, or 1 to 5, wt. %, based on the total weight of the additive package. Combinations of various amine compounds are also contemplated.

The amine compound includes at least one nitrogen atom. Furthermore, in some configurations, the amine compound does not include triazoles, triazines, or similar compounds where there are three or more nitrogen atoms in the body of a cyclic ring. The amine compound may be aliphatic.

In some embodiments, the amine compound consists of, or consists essentially of, hydrogen, carbon, nitrogen, and oxygen. Alternatively, the amine compound may consist of, or consist essentially of, hydrogen, carbon, and nitrogen. In the context of the amine compound, the phrase "consist essentially of" refers to compounds where at least 95 mole % of the amine compound are the recited atoms (i.e., hydrogen, carbon, nitrogen, and oxygen; or hydrogen, carbon, and nitrogen). For example, if the amine compound consists essentially of hydrogen, carbon, nitrogen, and oxygen, at least 95 mole % of the amine compound is hydrogen, carbon, nitrogen, and oxygen. In certain configurations, at least 96, at least 97, at least 98, at least 99, or at least 99.9, mole %, of the amine compound are hydrogen, carbon, nitrogen and oxygen, or, in other embodiments, are carbon, nitrogen, and hydrogen.

The amine compound may consist of covalent bonds. The phrase "consist of covalent bonds" is intended to exclude those compounds which bond to the amine compound through an ionic association with one or more ionic atoms or compounds. That is, in configurations where the amine compound consists of covalent bonds, the amine compound excludes salts of amine compounds, for example, phosphate amine salts and ammonium salts. As such, in certain embodiments, the lubricant composition is free of a salt of the amine compound. More specifically, the lubricant composition may be free of a phosphate amine salt, ammonium salt, and/or amine sulfate salt.

The amine compound may be a monomeric acyclic amine compound having a weight average molecular weight of less than 500. Alternatively, the monomeric acyclic amine compound may have a weight average molecular weight of less than 450, less than 400, less than 350, less than 300, less than 250, less than 200, or less than 150. Alternatively still, the amine compound may have a weight average molecular weight of at least 30, at least 50, at least 75, at least 100, at least 150, at least 200, or at least 250.

The term "acyclic" is intended to refer to compounds which are free from any cyclic structures and to exclude aromatic structures. For example, the monomeric acyclic amine compound does not include compounds having a ring having at least three atoms bonded together in a cyclic structure and those compounds including benzyl, phenyl, or triazole groups.

The monomeric acyclic amine compound may be exemplified by general formula (X):

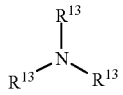

(X)

where each $R^{13}$ is independently a hydrogen atom or a hydrocarbyl group. The hydrocarbyl group designated by $R^{13}$ may have the same meaning as R described above with respect to general formula (I). For example, each $R^{13}$ may independently be a hydrocarbyl group including an alcohol group, an amino group, an amide group, an ether group, or an ester group. The monomeric acyclic amine includes monoamines and polyamines (including two or more amine groups).

In certain embodiments, at least one group designated by $R^{13}$ is unsubstituted. Alternatively, two or three groups designated by $R^{13}$ are unsubstituted. Alternatively still, it is contemplated that one, two, or three groups designated by $R^{13}$ are substituted. As outlined above with respect to R in general formula (I), the term "substituted" indicates that the designated group includes at least one substituent group, and/or that the designated group includes at least one heteroatom or heterogroup.

Exemplary alkyl $R^{13}$ groups may be independently selected from methyl, ethyl, n-propyl, n-butyl, sec-butyl, tert-butyl, n-hexyl, n-octyl, 2-ethylhexyl, n-nonyl, n-decyl, n-undecyl, n-dodecyl, n-tridecyl, n-tetradecyl, n-hexadecyl, or n-octadecyl.

Exemplary monomeric acyclic amine compounds include, but are not limited to, primary, secondary, and tertiary amines, such as:

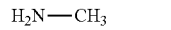

methylamine

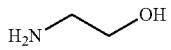

ethanolamine

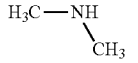

dimethylamine

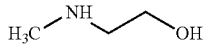

methylethanolamine

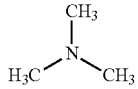

trimethylamine

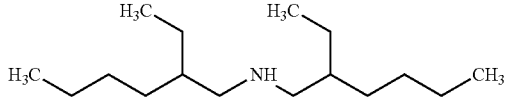

bis (2-ethylhexyl) amine

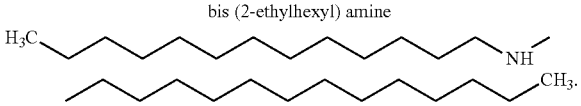

ditridecylamine

The monomeric acyclic amine compound may alternatively be one or more other primary amines such as ethylamine, n-propylamine, isopropylamine, n-butylamine, isobutylamine, sec-butylamine, tert-butylamine, pentylamine, and hexylamine; primary amines of the formulas: $CH_3—O—C_2H_4—NH_2$, $C_2H_5—O—C_2H_4—NH_2$, $CH_3—O—C_3H_6—NH_2$, $C_2H_5—O—C_3H_6—NH_2$, $C_4H_9—O—C_4H_8—NH_2$, $HO—C_2H_4—NH_2$, $HO—C_3H_6—NH_2$ and $HO—C_4H_8—NH_2$; secondary amines, for example diethylamine, methylethylamine, di-n-propylamine, diisopropylamine, diisobutylamine, di-sec-butylamine, di-tert-butylamine, dipentylamine, dihexylamine; and also secondary amines of the formulas: $(CH_3—O—C_2H_4)_2NH$, $(C_2H_5—O—C_2H_4)_2NH$, $(CH_3—O—C_3H_6)_2NH$, $(C_2H_5—O—C_3H_6)_2NH$, $(n\text{-}C_4H_9—O—C_4H_8)_2NH$, $(HO—C_2H_4)_2NH$, $(HO—C_3H_6)_2NH$ and $(HO—C_4H_8)_2NH$; and polyamines, such as n-propylenediamine, 1,4-butanediamine, 1,6-hexanediamine, diethylenetriamine, triethylenetetramine and tetraethylenepentamines, and also their alkylation products, for example 3-(dimethylamino)-n-propylamine, N,N-dimethylethylenediamine, N,N-diethylethylenediamine, and N,N,N',N'-tetramethyldiethylenetriamine.

Alternatively, the amine compound may be a monomeric cyclic amine compound. The monomeric cyclic amine compound may have a weight average molecular weight of from 100 to 1200, 200 to 800, or 200 to 600. Alternatively, the monomeric cyclic amine compound may have a weight average molecular weight of less than 500, or at least 50. In some embodiments, the monomeric cyclic amine compound is free from aromatic groups, such as phenyl and benzyl rings. In other embodiments, the monomeric cyclic amine compound is aliphatic.

The monomeric cyclic amine compound may include two or fewer nitrogen atoms per molecule. Alternatively, the monomeric cyclic amine compound may include only one nitrogen per molecule. The phrase "nitrogen per molecule" refers to the total number of nitrogen atoms in the entire molecule, including the body of the molecule and any substituent groups. In certain embodiments, the monomeric cyclic amine compound includes one or two nitrogen atoms in the cyclic ring of the monomeric cyclic amine compound.

The monomeric cyclic amine compound may be exemplified by the general formula (XI):

(XI)

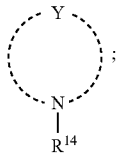

;

or general formula (XII):

(XII)

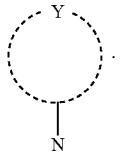

.

In general formulas (XI) and (XII), Y represents the type and number of atoms necessary to complete the cyclic ring of general formulas (XI) or (XII). The ring designated by Y may include from 2 to 20, 3 to 15, 5 to 15, or 5 to 10, carbon atoms. The ring designated by Y may be a substituted or unsubstituted, branched or unbranched, divalent hydrocarbon group that includes one or more hetero atoms, such as oxygen, or sulfur, and may include one or more heterogroups. In addition to including heteroatoms and/or heterogroups, the ring designated by Y may include one or more hydrocarbyl substituent groups, as described above with respect to R in general formula (I). In certain embodiments, the ring designated by Y is free from nitrogen heteroatoms, or free from any heteroatoms. The heteroatoms, heterogroups, and/or substituent groups may be bonded to different atoms in the divalent hydrocarbon group designated by Y. The substituent nitrogen atom in general formula (XII) may be bonded to one or more hydrogen atoms, or may be bonded to one or two hydrocarbyl groups.

In formula (XI), $R^{14}$ is a hydrogen atom or a hydrocarbyl group. The hydrocarbyl group designated by $R^{14}$ may have the same meaning as R described above with respect to formula (I). For example, $R^{14}$ may be an alcohol group, an amino group, an alkyl group, an amide group, an ether group, or an ester group. $R^{14}$ may have 1 to 50, 1 to 25, 1 to 17, 1 to 15, 1 to 12, 1 to 8, 1 to 6, or 1 to 4, carbon atoms. $R^{14}$ may be straight or branched. For example, each $R^{12}$ may be an alcohol group, amino group, alkyl group, amide group, ether group, or ester group having 1 to 50 carbon atoms, with the designated functional group (alcohol, etc.), heteroatom, or heterogroup bonded at various positions on the carbon chain. The substituent nitrogen atom in general formula (XII) may be bonded to one or more hydrogen atoms, or may be bonded to one or two hydrocarbyl groups, such as those described above with respect to $R^{14}$.

In one more specific embodiment, the monomeric cyclic amine compound may be exemplified by general formula (XIII):

(XIII)

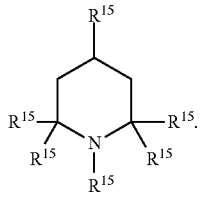

.

In general formula (XIII), each $R^{15}$ is independently a hydrogen atom or a hydrocarbyl group having from 1 to 17 carbon atoms. The hydrocarbyl group designated by $R^{15}$ may have the same meaning as R in general formula (I). For example, each $R^{15}$ may independently be substituted with an alcohol group, an amino group, an amide group, an ether group, or an ester group. Each $R^{15}$ may independently have from 1 to 17, 1 to 15, 1 to 12, 1 to 8, 1 to 6, or 1 to 4, carbon atoms. In certain embodiments, at least one group designated by $R^{15}$ is unsubstituted. Alternatively, at least two, three, four, five, or six groups designated by $R^{15}$ are unsubstituted. Alternatively still, it is contemplated that one, two, three, four, five, or six groups designated by $R^{15}$ are substituted. For example, each $R^{15}$ may be an alcohol group, amino group, alkyl group, amide group, ether group, or ester group having 1 to 17 carbon atoms, with the designated functional group (alcohol, etc) bonded at various positions on the carbon chain.

Exemplary monomeric cyclic amine compounds include:

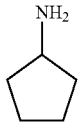

cyclopentylamine

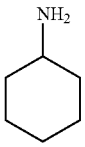

cyclohexylamine

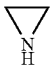

aziridine

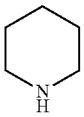

piperidine

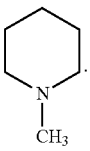

n-methylpiperidine

In some embodiments, the monomeric acyclic amine compound or the monomeric cyclic amine compound may be a sterically hindered amine compound. In one or more embodiments, the sterically hindered amine compound may have a weight average molecular weight of from 100 to 1200. Alternatively, the sterically hindered amine compound may have a weight average molecular weight of from 200 to 800, or from 200 to 600. Alternatively still, the sterically hindered amine compound may have a weight average molecular weight of less than 500.

As used herein, the term "sterically hindered amine compound" means an organic molecule having fewer than two hydrogen atoms bonded to at least one alpha-carbon with reference to a secondary or tertiary nitrogen atom. In other embodiments, the term "sterically hindered amine compound" means an organic molecule having no hydrogen atoms bonded to at least one alpha-carbon with reference to a secondary or tertiary nitrogen atom. In still other embodiments, the term "sterically hindered amine compound" means an organic molecule having no hydrogen atoms bonded to each of at least two alpha-carbons with reference to a secondary or tertiary nitrogen atom.

The sterically hindered amine compound may have general formula (XIV) or (XV):

(XIV)

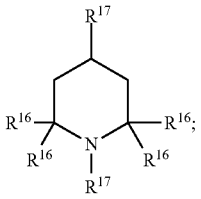

-continued (XV)

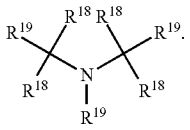

In general formula (XIV), each $R^{16}$ is independently a hydrogen atom or a hydrocarbyl group having from 1 to 17 carbon atoms, wherein at least two of $R^{16}$ are an alkyl group in one molecule; and $R^{17}$ is independently a hydrogen atom or a hydrocarbyl group having from 1 to 17 carbon atoms. In general formula (XV), each $R^{18}$ is independently a hydrogen atom or a hydrocarbyl group having from 1 to 17 carbon atoms, wherein at least two of $R^{18}$ are an alkyl group, and each $R^{19}$ is independently a hydrogen atom or a hydrocarbyl group having from 1 to 17 carbon atoms.

The groups designated by $R^{16}$, $R^{17}$, $R^{18}$, and $R^{19}$ may have the same meaning as R described above with respect to general formula (I). For example, each $R^{16}$, $R^{17}$, $R^{18}$, and $R^{19}$ may independently substituted with an alcohol group, an amide group, an ether group, or an ester group, and each $R^{16}$, $R^{17}$, $R^{18}$, and $R^{19}$ may independently have from 1 to 17, 1 to 15, 1 to 12, 1 to 8, 1 to 6, or 1 to 4, carbon atoms.

In certain embodiments, at least one group designated by $R^{16}$, $R^{17}$, $R^{18}$ and $R^{19}$ is unsubstituted. Alternatively, at least two, three, four, five, or six groups designated by $R^{16}$, $R^{17}$, $R^{18}$, and $R^{19}$ are unsubstituted. In other embodiments, every group designated by $R^{16}$, $R^{17}$, $R^{18}$, and $R^{19}$ is unsubstituted. Alternatively still, it is contemplated that one, two, three, four, five, or six groups designated by $R^{16}$, $R^{17}$, $R^{18}$, and $R^{19}$ are substituted.

Exemplary $R^{16}$, $R^{17}$, $R^{18}$, and $R^{19}$ groups may be independently selected from methyl, ethyl, n-propyl, n-butyl, sec-butyl, tert-butyl, n-hexyl, n-octyl, 2-ethylhexyl, n-nonyl, n-decyl, n-undecyl, n-dodecyl, n-tridecyl, n-tetradecyl, n-hexadecyl, or n-octadecyl.

In general formula (XIV), at least two, at least three, or all four groups, designated by $R^{16}$ are each independently an alkyl group. Similarly, in general formula (XV), at least two groups designated by $R^{18}$ are an alkyl group. Alternatively, at least three, or all four groups, designated by $R^{18}$ are an alkyl group.

The sterically hindered amine compound of general formula (XIV) may be exemplified by the following compounds:

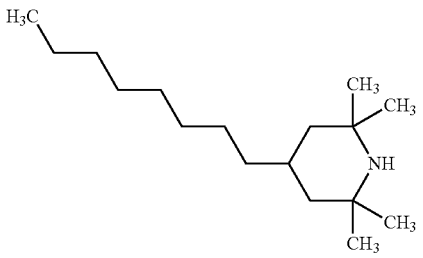

2,2,6,6-tetramethyl-4-octylpiperdine

-continued

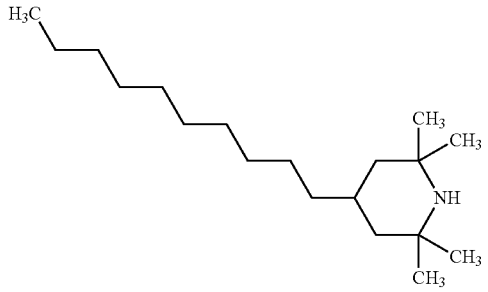

2,2,6,6-tetramethyl-4-decylpiperdine

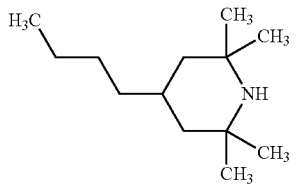

2,2,6,6-tetramethyl-4-butylpiperdine

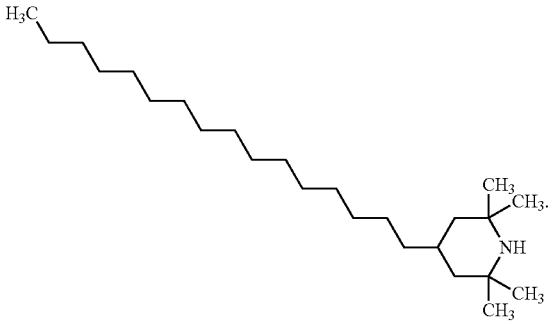

2,2,6,6-tetramethyl-4-hexadecylpiperdine

The sterically hindered amine compound of general formula (XV) is acyclic. The term "acyclic" is intended to mean that the sterically hindered amine compound of general formula (XV) is free from any cyclic structures and aromatic structures. The sterically hindered amine compound of general formula (XV) can be exemplified by:

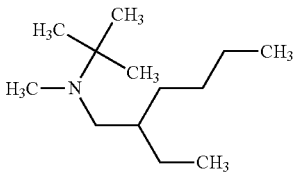

N-tert-butyl-2-ethyl-N-methyl-hexan-1-amine

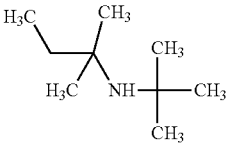

tert-amyl-tert-butylamine

-continued

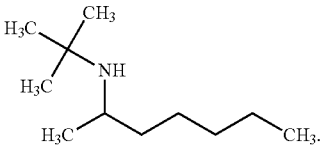

N-tert-butylheptan-2-amine

The sterically hindered amine compound may alternatively be exemplified by the general formula (XVI):

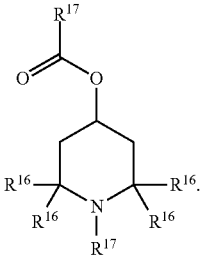

(XVI)

In general formula (XVI), each $R^{16}$ and $R^{17}$ are as described above, wherein at least three of $R^{16}$ are each independently an alkyl group. The sterically hindered amine compound of general formula (XVI) may be exemplified by the following compounds:

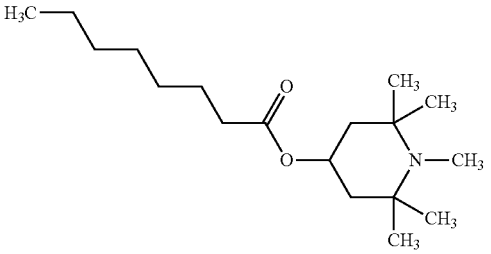

(1,2,2,6,6-pentamethyl-4-piperidyl) octanoate

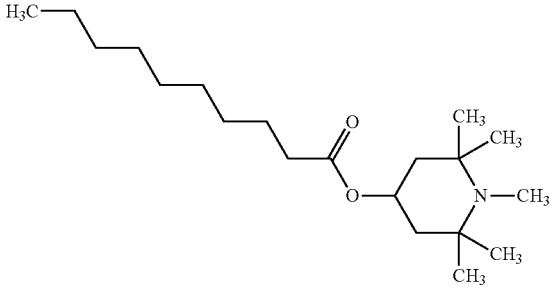

(1,2,2,6,6-pentamethyl-4-piperidyl) decanoate

-continued

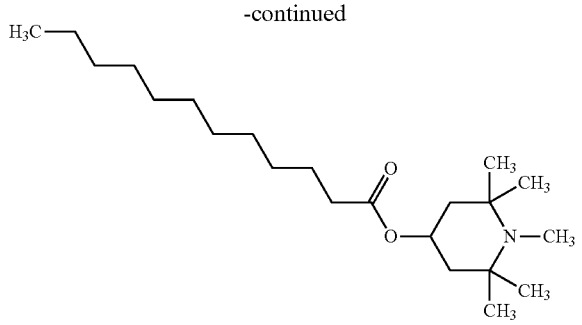

(1,2,2,6,6-pentamethyl-4-piperidyl) dodecanoate

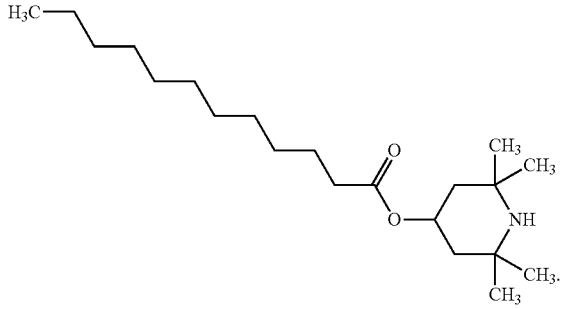

(2,2,6,6-tetramethyl-4-piperidyl) dodecanoate

The sterically hindered amine compound may include a single ester group. However, the sterically hindered amine compound may alternatively be free from ester groups. In certain embodiments, the sterically hindered amine compound may include at least one, or only one, piperidine ring.

The epoxide compound and the amine compound may be provided in the lubricant composition or additive package in an amount such that 1 part of oxirane oxygen is provided for every 1 to 20 parts nitrogen in the amine compound. Alternatively, the epoxide compound and the amine compound may be provided in an amount such that 1 part of oxirane oxygen is provided for every 1 to 15, 1 to 10, or 1 to 5, parts nitrogen, in the amine compound within the lubricant composition or additive package.

In one specific embodiment, the lubricant composition may consist, or consist essentially of, a base oil, the epoxide compound, and the amine compound. It is also contemplated that the lubricant composition may consist of, or consist essentially of, the base oil, the epoxide compound, and the amine compound, in addition to one or more of additives that do not materially affect the functionality or performance of the epoxide compound. For example, compounds that materially affect the overall performance of the lubricant composition may include compounds which negatively impact the TBN boost, the lubricity, the fluoropolymer seal compatibility, the corrosion inhibition, or the acidity of the lubricant composition.

In other embodiments, the additive package may consist, or consist essentially of, the epoxide compound and the amine compound. It is also contemplated that the additive package may consist of, or consist essentially of, the epoxide compound, and the amine compound in addition to one or more of additives that do not compromise the functionality or performance of the epoxide compound. When used in reference to the additive package, the term "consisting essentially of" refers to the additive package being free of compounds that materially affect the overall performance of the additive package. For example, compounds that materially affect the overall performance of the additive package may include compounds which negatively impact the TBN boost, the lubricity, the fluoropolymer seal compatibility, the corrosion inhibition, or the acidity of the additive package.

The lubricant composition may include a base oil. The base oil is classified in accordance with the American Petroleum Institute (API) Base Oil Interchangeability Guidelines. In other words, the base oil may be further described as one or more of five types of base oils: Group I (sulphur content >0.03 wt. %, and/or <90 wt. % saturates, viscosity index 80-119); Group II (sulphur content less than or equal to 0.03 wt. %, and greater than or equal to 90 wt. % saturates, viscosity index 80-119); Group III (sulphur content less than or equal to 0.03 wt. %, and greater than or equal to 90 wt. % saturates, viscosity index greater than or equal to 119); Group IV (all polyalphaolefins (PAO's)); and Group V (all others not included in Groups I, II, III, or IV).

In some embodiments, the base oil is selected from the group of API Group I base oils; API Group II base oils; API Group III base oils; API Group IV base oils; API Group V base oils; and combinations thereof. In one specific embodiment, the base oil includes API Group II base oils.

The base oil may have a viscosity of from 1 to 50, 1 to 40, 1 to 30, 1 to 25, or 1 to 20, cSt, when tested according to ASTM D445 at 100° C. Alternatively, the viscosity of the base oil may range from 3 to 17, or 5 to 14, cSt, when tested according to ASTM D445 at 100° C.

The base oil may be further defined as a crankcase lubricant oil for spark-ignited and compression-ignited internal combustion engines, including automobile and truck engines, two-cycle engines, aviation piston engines, marine engines, and railroad diesel engines. Alternatively, the base oil can be further defined as an oil to be used in gas engines, diesel engines, stationary power engines, and turbines. The base oil may be further defined as heavy or light duty engine oil.

In still other embodiments, the base oil may be further defined as synthetic oil that includes one or more alkylene oxide polymers and interpolymers, and derivatives thereof. The terminal hydroxyl groups of the alkylene oxide polymers may be modified by esterification, etherification, or similar reactions. Typically, these synthetic oils are prepared through polymerization of ethylene oxide or propylene oxide to form polyoxyalkylene polymers which can be further reacted to form the synthetic oil. For example, alkyl and aryl ethers of these polyoxyalkylene polymers may be used. For example, methylpolyisopropylene glycol ether having a weight average molecular weight of 1000; diphenyl ether of polyethylene glycol having a molecular weight of 500-1000; or diethyl ether of polypropylene glycol having a weight average molecular weight of 1,000-1500 and/or mono- and polycarboxylic esters thereof, such as acetic acid esters, mixed $C_3$-$C_8$ fatty acid esters, and the $C_{13}$ oxo acid diester of tetraethylene glycol may also be utilized as the base oil. Alternatively, the base oil may include a substantially inert, normally liquid, organic diluent, such as mineral oil, naptha, benzene, toluene, or xylene.

The base oil may include less than 90, less than 80, less than 70, less than 60, less than 50, less than 40, less than 30, less than 20, less than 10, less than 5, less than 3, less than 1, or be free from, an estolide compound (i.e., a compound including one or more estolide groups), based on the total weight of the lubricant composition.

The base oil may be present in the lubricant composition in an amount of from 1 to 99.9, 50 to 99.9, 60 to 99.9, 70 to 99.9, 80 to 99.9, 90 to 99.9, 75 to 95, 80 to 90, or 85 to 95, wt. %, based on the total weight of the lubricant composition. Alternatively, the base oil may be present in the lubricant composition in amounts of greater than 1, 10, 20, 30, 40, 50, 60, 70, 75, 80, 85, 90, 95, 98, or 99, wt. %, based on the total weight of the lubricant composition. In various embodiments, the amount of base oil in a fully formulated lubricant composition (including diluents or carrier oils present) ranges from 50 to 99, 60 to 90, 80 to 99.5, 85 to 96, or 90 to 95, wt. %, based on the total weight of the lubricant composition. Alternatively, the base oil may be present in the lubricant composition in an amount of from 0.1 to 50, 1 to 25, or 1 to 15, wt. %, based on the total weight of the lubricant composition. In various embodiments, the amount of base oil in an additive package, if included, (including diluents or carrier oils present) ranges from 0.1 to 50, 1 to 25, or 1 to 15, wt. %, based on the total weight of the additive package.

In one or more embodiments, the lubricant composition may be classified as a low SAPS lubricant having a sulfated ash content of no more than 3, 2, 1, or 0.5, wt. %, based on the total weight of the lubricant composition. "SAPS" refers to sulfated ash, phosphorous and sulfur.

The lubricant composition may have a TBN value of at least 1, at least 3, at least 5, at least 7, at least 9, mg KOH/g of lubricant composition, when tested according to ASTM D2896. Alternatively, the lubricant composition has a TBN value of from 3 to 100, 3 to 75, 50 to 90, 3 to 45, 3 to 35, 3 to 25, 3 to 15, or 9 to 12, mg KOH/g of lubricant composition, when tested according to ASTM D2896.

In certain embodiments, the lubricant composition is a multigrade lubricant composition identified by the viscometric descriptor SAE15WX, SAE 10WX, SAE 5WX or SAE 0WX, where X is 8, 12, 16, 20, 30, 40, or 50. The characteristics of one or more of the different viscometric grades can be found in the SAE J300 classification.

The lubricant composition may have a phosphorus content of less than 1500, less than 1200, less than 1000, less than 800, less than 600, less than 400, less than 300, less than 200, or less than 100, or 0, ppm, as measured according to the ASTM D5185 standard, or as measured according to the ASTM D4951 standard. The lubricant composition may have a sulfur content of less than 3000, less than 2500, less than 2000, less than 1500, less than 1200, less than 1000, less than 700, less than 500, less than 300, or less than 100, ppm, as measured according to the ASTM D5185 standard, or as measured according to the ASTM D4951 standard.

Alternatively, the lubricant composition may have a phosphorous content of from 1 to 1000, 1 to 800, 100 to 700, or 100 to 600, ppm, as measured according to the ASTM D5185 standard.

The lubricant composition may be free from, or substantially free from, a carboxylic acid ester and/or phosphate ester. For example, the lubricant composition may include less than 20, less than 15, less than 10, less than 5, less than 3, less than 1, less than 0.5, or less than 0.1, wt. %, carboxylic acid ester and/or phosphate ester. The carboxylic acid ester and/or phosphate ester may be included as conventional base oil in water-reactive functional fluids. The lubricant composition may be free from a carboxylic acid ester base oil and/or phosphate ester base oil, which are liquid at a steady state temperature of 25° C. and a steady state pressure of 1 atmosphere. The lubricant composition may be unreactive with water. By unreactive with water, it is meant that less than 5, 4, 3, 2, 1, 0.5, or 0.1, wt., %, of the lubricant composition reacts with water at 1 atmosphere of pressure and 25° C.

In various embodiments, the lubricant composition is substantially free of water, e.g., the lubricant composition includes less than 5, less than 4, less than 3, less than 2, less than 1, less than 0.5, or less than 0.1, wt. %, of water, based on the total weight of the lubricant composition. Alternatively, the lubricant composition may be completely free of water.

The lubricant composition may be a lubricant composition, such as a crankcase lubricant composition, having a total additive treat rate of at least 3, at least 4, at least 5, at least 6, at least 7, or at least 8, wt. %, based on a total weight of the lubricant composition. Alternatively, the lubricant composition may have a total additive treat rate ranging from 3 to 20, 4 to 18, 5 to 16, or 6 to 14, wt. %, based on a total weight of the lubricant composition. The term "total additive treat rate" refers to the total weight percentage of additives included in the lubricant composition. The additives accounted for in the total additive treat rate include, but are not limited to, epoxide compounds, amine compounds, dispersants, detergents, aminic antioxidants, phenolic antioxidants, anti-foam additives, antiwear additives, pour point depressants, viscosity modifiers, and combinations thereof. In certain embodiments, an additive is any compound in the lubricant composition other than the base oil. In other words, the total additive treat rate calculation does not account for the base oil as an additive.

The additive package may include, but is not limited to, epoxide compounds, amine compounds, dispersants, detergents, aminic antioxidants, phenolic antioxidants, anti-foam additives, antiwear additives, pour point depressants, viscosity modifiers, and combinations thereof. The lubricant composition may include the additive package in amount of at least 3, at least 4, at least 5, at least 6, at least 7, or at least 8, wt. %, based on a total weight of the lubricant composition. Alternatively, the lubricant composition may include the additive package in an amount of from 3 to 20, 4 to 18, 5 to 16, or 6 to 14, wt. %, based on a total weight of the lubricant composition. In some embodiments, the additive package does not account for the weight of the base oil as an additive. Although not required, the additive package includes all compounds in the lubricant composition other than the base oil. However, it is to be appreciated that certain individual components can be independently and individually added to the lubricant composition separate from the addition of the additive package to the lubricant composition, yet still be considered part of the additive package once the additive which was individually added into the lubricant composition is present in the lubricant composition along with the other additives.

The additive package refers to the collective amount of the epoxide compounds, amine compounds, dispersants, detergents, aminic antioxidants, phenolic antioxidants, anti-foam additives, antiwear additives, pour point depressants, viscosity modifiers, or combinations thereof in a solution, mixture, concentrate, or blend, such as the lubricant composition. In some embodiments, the term "additive package" does not require that these additives are physically packaged together or blended together before addition to the base oil. Thus, a base oil which includes the epoxide compound and the dispersant, each added to the base oil separately, could be interpreted to be a lubricant composition that includes an additive package comprising the epoxide compound and the dispersant. In other embodiments, the additive package refers to a blend of the epoxide compounds, amine compounds, dispersants, detergents, aminic antioxidants, phenolic antioxidants, anti-foam additives, antiwear additives, pour point depressants, viscosity modifiers, or combinations thereof. The additive package may be blended into the base oil to make the lubricant composition.

The additive package may be formulated to provide the desired concentration in the lubricant composition when the additive package is combined with a predetermined amount of base oil. It is to be appreciated that most references to the lubricant composition throughout this disclosure also apply to the description of the additive package. For example, it is to be appreciated that the additive package may include, or exclude, the same components as the lubricant composition, albeit in different amounts.

In one embodiment, the lubricant composition passes ASTM D4951 for phosphorus content. ASTM D4951 is a standard test method for determination of additive elements in lubricant compositions by inductively coupled plasma atomic emission spectrometry (ICP-OES).

In another embodiment, the lubricant composition passes ASTM D6795, which is a standard test method for measuring the effect on filterability of lubricant compositions after treatment with water and dry ice and a short (30 min) heating time. ASTM D6795 simulates a problem that may be encountered in a new engine run for a short period of time, followed by a long period of storage with some water in the oil. ASTM D6795 is designed to determine the tendency of a lubricant composition to form a precipitate that can plug an oil filter.

In another embodiment, the lubricant composition passes ASTM D6794, which is a standard test method for measuring the effect on filterability of lubricant composition after treatment with various amounts of water and a long (6 h) heating time. ASTM D6794 simulates a problem that may be encountered in a new engine run for a short period of time, followed by a long period of storage with some water in the oil. ASTM D6794 is also designed to determine the tendency of the lubricant composition to form a precipitate that can plug an oil filter.

In another embodiment, the lubricant composition passes ASTM D6922, which is a standard test method for determining homogeneity and miscibility in lubricant compositions. ASTM D6922 is designed to determine if a lubricant composition is homogeneous and will remain so, and if the lubricant composition is miscible with certain standard reference oils after being submitted to a prescribed cycle of temperature changes.

In another embodiment, the lubricant composition passes ASTM D5133, which is a standard test method for low temperature, low shear rate, viscosity/temperature dependence of lubricating oils using a temperature-scanning technique. The low-temperature, low-shear viscometric behavior of a lubricant composition determines whether the lubricant composition will flow to a sump inlet screen, then to an oil pump, then to sites in an engine requiring lubrication in sufficient quantity to prevent engine damage immediately or ultimately after cold temperature starting.

In another embodiment, the lubricant composition passes ASTM D5800 and/or ASTM D6417, both of which are test methods for determining an evaporation loss of a lubricant composition. The evaporation loss is of particular importance in engine lubrication, because where high temperatures occur, portions of a lubricant composition can evaporate and thus alter the properties of the lubricant composition.

In another embodiment, the lubricant composition passes ASTM D6557, which is a standard test method for evaluation of rust preventive characteristics of lubricant compositions. ASTM D6577 includes a Ball Rust Test (BRT) procedure for evaluating the anti-rust ability of lubricant compositions. This BRT procedure is particularly suitable for the evaluation of lubricant compositions under low-temperature and acidic service conditions.

In another embodiment, the lubricant composition passes ASTM D4951 for sulfur content. ASTM D4951 is a standard test method for determination of additive elements in lubricant compositions by ICP-OES. In addition, the lubricant composition also passes ASTM D2622, which is a standard test method for sulfur in petroleum products by wavelength dispersive x-ray fluorescence spectrometry.

In another embodiment, the lubricant composition passes ASTM D6891, which is a standard test method for evaluating a lubricant composition in a sequence IVA spark-ignition engine. ASTM D6891 is designed to simulate extended engine idling vehicle operation. Specifically, ASTM D6891 measures the ability of a lubricant composition to control camshaft lobe wear for spark-ignition engines equipped with an overhead valve-train and sliding cam followers.

In another embodiment, the lubricant composition passes ASTM D6593, which is a standard test method for evaluating lubricant compositions for inhibition of deposit formation in a spark-ignition internal combustion engine fueled with gasoline and operated under low-temperature, light-duty conditions. ASTM D6593 is designed to evaluate a lubricant composition's control of engine deposits under operating conditions deliberately selected to accelerate deposit formation.

In another embodiment, the lubricant composition passes ASTM D6709, which is a standard test method for evaluating lubricant compositions in a sequence VIII spark-ignition engine. ASTM D6709 is designed to evaluate lubricant compositions for protection of engines against bearing weight loss.

In another embodiment, the lubricant composition passes two, three, four, or more of the following standard test methods: ASTM D4951, ASTM D6795, ASTM D6794, ASTM D6922, ASTM D5133, ASTM D6557, ASTM D6891, ASTM D2622, ASTM D6593, and ASTM D6709.

In another embodiment, the lubricant composition passes all of the following standard test methods: ASTM D4951, ASTM D6795, ASTM D6794, ASTM D6922, ASTM D5133, ASTM D6557, ASTM D6891, ASTM D2622, ASTM D6593, and ASTM D6709.

The lubricant composition or the additive package may further include a dispersant in addition to the epoxide compound and/or the amine compound. The dispersant may be a polyalkene amine. The polyalkene amine includes a polyalkene moiety. The polyalkene moiety is the polymerization product of identical or different, straight-chain or branched $C_{2-6}$ olefin monomers. Examples of suitable olefin monomers are ethylene, propylene, 1-butene, isobutene, 1-pentene, 2-methyl butene, 1-hexene, 2-methylpentene, 3-methylpentene, and 4-methylpentene. The polyalkene moiety has a weight average molecular weight of from 200 to 10000, 500 to 10000, or 800 to 5000.

In one embodiment, the polyalkene amine is derived from polyisobutenes. Particularly suitable polysiobutenes are known as "highly reactive" polyisobutenes which feature a high content of terminal double bonds. Terminal double bonds are alpha-olefinic double bonds of the type shown in general formula (XVII):

(XVII)

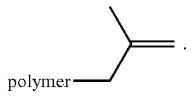

The bonds shown in general formulas (XVII) are known as vinylidene double bones. Suitable highly reactive polypolyisobutenes are, for example, polyisobutenes which have a fraction of vinylidene double bonds of greater than 70, 80, or 85, mole %. Preference is given in particular to polyisobutenes which have uniform polymer frameworks. Uniform polymer frameworks have in particular those polyisobutenes which are composed of at least 85, 90, or 95, wt. %, of isobutene units. Such highly reactive polyisobutenes preferably have a number-average molecular weight in the abovementioned range. In addition, the highly reactive polyisobutenes may have a polydispersity of from 1.05 to 7, or 1.1 to 2.5. The highly reactive polyisobutenes may have a polydispersity less than 1.9, or less than 1.5. Polydispersity refers to the quotients of weight-average molecular weight Mw divided by the number-average molecular weight Mn.

The amine dispersant may include moieties derived from succinic anhydride and having hydroxyl and/or amino and/or amido and/or imido groups. For example, the dispersant may be derived from polyisobutenylsuccinic anhydride which is obtainable by reacting conventional or highly reactive polyisobutene having a weight average molecular weight of from 500 to 5000 with maleic anhydride by a thermal route or via the chlorinated polyisobutene. For examples, derivatives with aliphatic polyamines such as ethylenediamine, diethylenetriamine, triethylenetetramine or tetraethylenepentamine may be used.

To prepare the polyalkene amine, the polyalkene component may be aminated in a known manner. An exemplary process proceeds via the preparation of an oxo intermediate by hydroformylation and subsequent reductive amination in the presence of a suitable nitrogen compound.

The dispersant may be a poly(oxyalkyl) radical or a polyalkylene polyamine radical of the general formula (XVIII):

$$R^{20}\text{—NH—}(C_1\text{-}C_6\text{-alkylene-NH})_m\text{—}C_1\text{-}C_6\text{-alkylene} \quad \text{(XVIII)}$$

where m is an integer of from 1 to 5, $R^{20}$ is a hydrogen atom or a hydrocarbyl group having from 1 to 6 carbon atoms with $C_1$-$C_6$ alkylene representing the corresponding bridged analogs of the alkyl radicals. The dispersant may also be a polyalkylene imine radical composed of from 1 to 10 $C_1$-$C_4$ alkylene imine groups; or, together with the nitrogen atom to which they are bonded, are an optionally substituted 5- to 7-membered heterocyclic ring which is optionally substituted by one to three $C_1$-$C_4$ alkyl radicals and optionally bears one further ring heteroatom such as oxygen or nitrogen.

Examples of suitable alkenyl radicals include mono- or polyunsaturated, preferably mono- or diunsaturated analogs of alkyl radicals has from 2 to 18 carbon atoms, in which the double bonds may be in any position in the hydrocarbon chain.

Examples of $C_4$-$C_{18}$ cycloalkyl radical include cyclobutyl, cyclopentyl and cyclohexyl, and also the analogs thereof substituted by 1 to 3 $C_1$-$C_4$ alkyl radicals. The $C_1$-$C_4$ alkyl radicals are, for example, selected from methyl, ethyl, iso- or n-propyl, n-, iso-, sec- or tert-butyl.

Examples of the arylalkyl radical include a $C_1$-$C_{18}$ alkyl group and an aryl group which are derived from a monocyclic or bicyclic fused or nonfused 4- to 7-membered, in particular 6 membered, aromatic or heteroaromatic group, such as phenyl, pyridyl, naphthyl and biphenyl.

If additional dispersants other than the dispersant described above are employed, these dispersants can be of various types. Suitable examples of dispersants include polybutenylsuccinic amides or -imides, polybutenylphosphonic acid derivatives and basic magnesium, calcium and barium sulfonates and phenolates, succinate esters and alkylphenol amines (Mannich bases), and combinations thereof.

If employed, the dispersant can be used in various amounts. The dispersant may be present in the lubricant composition in an amount of from 0.01 to 15, 0.1 to 12, 0.5 to 10, or 1 to 8, wt. %, based on the total weight of the lubricant composition. Alternatively, the dispersant may be present in amounts of less than 15, less than 12, less than 10, less than 5, or less than 1, wt. %, each based on the total weight of the lubricant composition.

In the additive package, the total weight of the dispersant and the epoxide compound is less than 50, less than 45, less than 40, less than 35, or less than 30, wt. %, of the additive package based on the total weight of the additive package.

The lubricant composition or the additive package may further include an antiwear additive, optionally comprising phosphorous. The antiwear additive may include sulfur- and/or phosphorus- and/or halogen-containing compounds, e.g., sulfurised olefins and vegetable oils, alkylated triphenyl phosphates, tritolyl phosphate, tricresyl phosphate, chlorinated paraffins, alkyl and aryl di- and trisulfides, amine salts of mono- and dialkyl phosphates, amine salts of methylphosphonic acid, diethanolaminomethyltolyltriazole, bis(2-ethylhexyl)aminomethyltolyltriazole, derivatives of 2,5-dimercapto-1,3,4-thiadiazole, ethyl 3-[(diisopropoxyphosphinothioyl)thio]propionate, triphenyl thiophosphate (triphenylphosphorothioate), tris(alkylphenyl) phosphorothioate and mixtures thereof, diphenyl monononylphenyl phosphorothioate, isobutylphenyl diphenyl phosphorothioate, the dodecylamine salt of 3-hydroxy-1,3-thiaphosphetane 3-oxide, trithiophosphoric acid 5,5,5-tris [isooctyl 2-acetate], derivatives of 2-mercaptobenzothiazole such as 1-[N,N-bis(2-ethylhexyl)aminomethyl]-2-mercapto-1H-1,3-benzothiazole, ethoxycarbonyl-5-octyldithio carbamate, and/or combinations thereof.

In some embodiments, the antiwear additive may be exemplified by a dihydrocarbyl dithiophosphate salt. The dihydrocarbyl dithiophosphate salt may be represented by the following general formula (XIX):

$$[R^{21}O(R^{22}O)PS(S)]_2M \quad \text{(XIX)}$$

where $R^{21}$ and $R^{22}$ are each hydrocarbyl groups independently having from 1 to 30, 1 to 20, 1 to 15, 1 to 10, or 1 to 5, carbon atoms, wherein M is a metal atom or an ammonium group. For example, $R^{21}$ and $R^{22}$ may each independently be $C_{1-20}$ alkyl groups, $C_{2-20}$ alkenyl groups, $C_{3-20}$ cycloalkyl groups, $C_{1-20}$ aralkyl groups or $C_{3-20}$ aryl groups. The groups designated by $R^{21}$ and $R^{22}$ may be substituted or unsubstituted. The hydrocarbyl groups designated by $R^{21}$ and $R^{22}$ groups may have the same meaning as described above with respect to R in general formula (I). The metal atom may be selected from the group including aluminum, lead, tin, manganese, cobalt, nickel, or zinc. The ammonium group may be derived from ammonia or a primary, secondary, or tertiary amine. The ammonium group may be of the formula $R^{23}R^{24}R^{25}R^{26}N^+$, wherein $R^{23}$, $R^{24}$, $R^{25}$, and $R^{26}$ each independently represents a hydrogen atom or a hydrocarbyl group having from 1 to 150 carbon atoms. In certain embodiments, $R^{23}$, $R^{24}$, $R^{25}$, and $R^{26}$ may each independently be hydrocarbyl groups having from 4 to 30 carbon atoms. The hydrocarbyl groups designated by $R^{23}$, $R^{24}$, $R^{25}$ and $R^{26}$ may have the same meaning and R in general formula (I). In one specific embodiment, the dihydrocarbyl dithiophosphate salt is zinc dialkyl dithiophosphate. The lubricant composition may include mixtures of different dihydrocarbyl dithiophosphate salts.

In certain embodiments, the dihydrocarbyl dithiophosphate salt includes a mixture of primary and secondary alkyl groups for, $R^{21}$ and $R^{22}$, wherein the secondary alkyl groups are in a major molar proportion, such as at least 60, at least 75, or at least 85, mole %, based on the number of moles of alkyl groups in the dihydrocarbyl dithiophosphate salt.

In some embodiments, the antiwear additive may be ashless. The antiwear additive may be further defined as a phosphate. In another embodiment, the antiwear additive is further defined as a phosphite. In still another embodiment, the antiwear additive is further defined as a phosphorothionate. The antiwear additive may alternatively be further defined as a phosphorodithioate. In one embodiment, the antiwear additive is further defined as a dithiophosphate. The antiwear additive may also include an amine such as a secondary or tertiary amine. In one embodiment, the antiwear additive includes an alkyl and/or dialkyl amine. Structures of suitable non-limiting examples of antiwear additives are set forth immediately below:

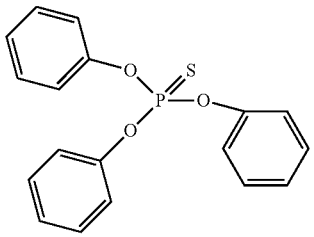

Triphenyl Phosphorothionate

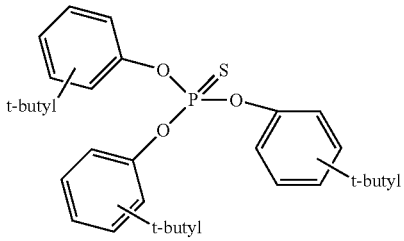

Butylated Triphenyl Phosphorothionate

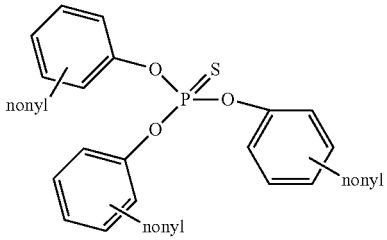

Nonyl Triphenyl Phosphorothionate

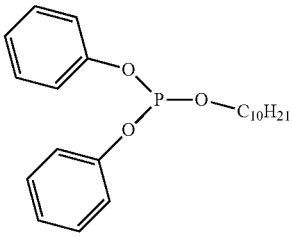

Decyl Diphenylphosphite

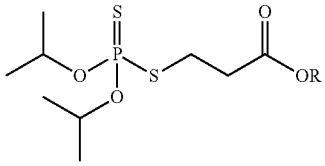

Neutral Dialkyl Dithiophosphate

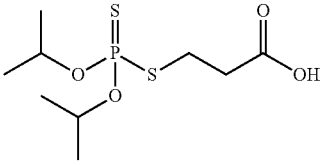

Acidic Dialkyl Dithiophosphate

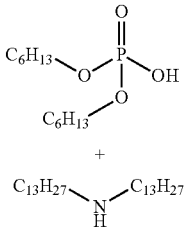

Amine Phospate + Ditridecyl Amine

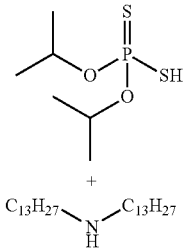

Isopropyl Phosphorodithioate + Ditridecyl Amine

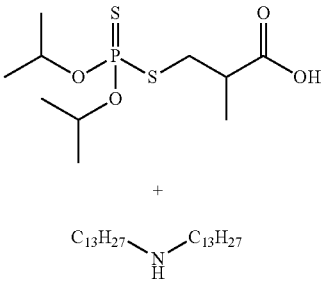

Acidic Dialkyl Dithiophosphate + Ditridecyl Amine

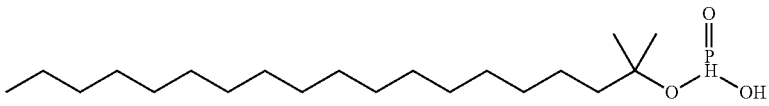

Dimethyloctadecyl Phosphonate

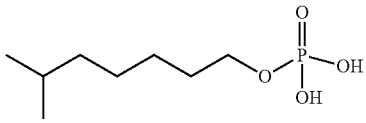

Iso-Octyl Phosphate + $C_{12}$-$C_{14}$ Amine

-continued

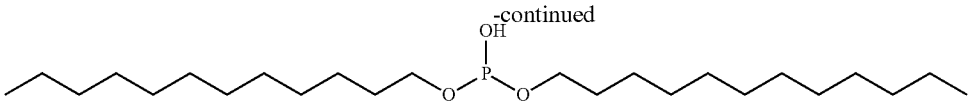

Dilauryl Hydrogen Phosphite

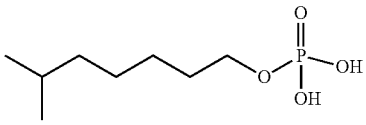

Iso-Octyl Phosphate + $C_{12}$-$C_{14}$ Amine

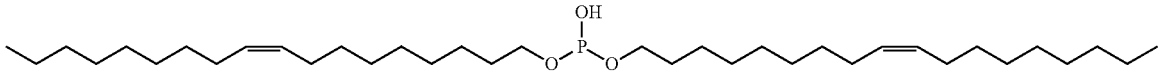

Dioleyl Hydrogen Phosphite

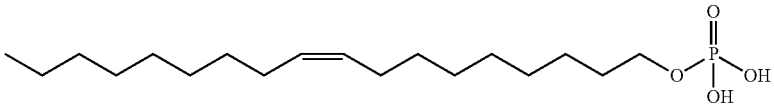

Oleyl Phosphate

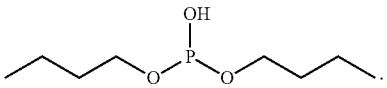

Dibutyl Hydrogen Phosphite

The antiwear additive can be present in the lubricant composition in an amount of from 0.1 to 20, 0.5 to 15, 1 to 10, 0.1 to 5, 0.1 to 1, 0.1 to 0.5, or 0.1 to 1.5, wt. %, each based on the total weight of the lubricant composition. Alternatively, the antiwear additive may be present in amounts of less than 20, less than 10, less than 5, less than 1, less than 0.5, or less than 0.1, wt. %, each based on the total weight of the lubricant composition. The additive package may also include the antiwear additive comprising phosphorous in an amount of from 0.1 to 20, 0.5 to 15, 1 to 10, 0.1 to 5, 0.1 to 1, 0.1 to 0.5, or 0.1 to 1.5, wt. %, each based on the total weight of the additive package.

The additive package may consist of, or consist essentially of, the antiwear additive and the epoxide compound. It is also contemplated that the lubricant composition may consist of, or consist essentially of, the epoxide compound and the antiwear additive in addition to one or more of additives that do not compromise the functionality or performance of the epoxide compound. Additionally, it is also contemplated that the additive package may consist of, or consist essentially of, the epoxide compound, an amine compound, and the antiwear additive, in addition to one or more additives that do not compromise the functionality or performance of the epoxide compound.

In various embodiments where the lubricant composition consists essentially or consists of the base oil and the epoxide compound; the base oil, the epoxide compound, and the amine compound; or the base oil, the epoxide compound, and the antiwear additive, or the base oil, the amine compound, the epoxide compound, and the antiwear additive, the lubricant composition is free of, or includes less than 0.01, 0.001, or 0.0001 wt. % of acids, amine curing agents, anhydrides, triazoles, and oxides.

The lubricant composition or the additive package may additionally include one or more additives to improve various chemical and/or physical properties of the lubricant composition. These additives may be in addition to the epoxide compound, in addition to the combination of the epoxide compound and the amine compound, or in combination with the amine compound, the epoxide compound, and the antiwear additive. Specific examples of the one or more additives include antioxidants, metal deactivators (or passivators), rust inhibitors, viscosity index improvers, pour point depressors, dispersants, detergents, and antifriction additives. Each of the additives may be used alone or in combination. The one or more additives can be used in various amounts, if employed. The lubricant composition may be formulated with the addition of several auxiliary components to achieve certain performance objectives for use in certain applications. For example, the lubricant composition may be a rust and oxidation lubricant formulation, a hydraulic lubricant formulation, turbine lubricant oil, and an internal combustion engine lubricant formulation. Accordingly, it is contemplated that the base oil may be formulated to achieve these objectives as discussed below.

If employed, the antioxidant can be of various types. Suitable antioxidants include alkylated monophenols, for example 2,6-di-tert-butyl-4-methylphenol, 2-tert-butyl-4,6-dimethylphenol, 2,6-di-tert-butyl-4-ethylphenol, 2,6-di-tert-butyl-4-n-butylphenol, 2,6-di-tert-butyl-4-isobutylphenol, 2,6-dicyclopentyl-4-methylphenol, 2-(α-methylcyclohexyl)-4,6-dimethylphenol, 2,6-dioctadecyl-4-methylphenol, 2,4,6-tricyclohexylphenol, 2,6-di-tert-butyl-4-methoxymethylphenol, 2,6-di-nonyl-4-methylphenol, 2,4-dimethyl-6(1'-methylundec-1'-yl)phenol, 2,4-dimethyl-6-(1'-methylheptadec-1'-yl)phenol, 2,4-dimethyl-6-(1'-methyltridec-1'-yl)phenol, and combinations thereof.

Further examples of suitable antioxidants includes alkylthiomethylphenols, for example 2,4-dioctylthiomethyl-6-tert-butylphenol, 2,4-dioctylthiomethyl-6-methylphenol, 2,4-dioctylthiomethyl-6-ethylphenol, 2,6-didodecylthiomethyl-4-nonylphenol, and combinations thereof. Hydroquinones and alkylated hydroquinones, for example 2,6-di-tert-butyl-4-methoxyphenol, 2,5-di-tert-butylhydroquinone, 2,5-di-tert-amylhydroquinone, 2,6-diphenyl-4-octadecyloxyphenol, 2,6-di-tert-butylhydroquinone, 2,5-di-tert-butyl-4-hydroxyanisole, 3,5-di-tert-butyl-4-hydroxyanisole, 3,5-di-tert-butyl-4-hydroxyphenyl stearate, bis-(3,5-di-tert-butyl-4-hydroxyphenyl)adipate, and combinations thereof, may also be utilized.

Furthermore, hydroxylated thiodiphenyl ethers, for example 2,2'-thiobis(6-tert-butyl-4-methylphenol), 2,2'-thiobis(4-octylphenol), 4,4'-thiobis(6-tert-butyl-3-methylphenol), 4,4'-thiobis(6-tert-butyl-2-methylphenol), 4,4'-thiobis-(3,6-di-sec-amylphenol), 4,4'-bis-(2,6-dimethyl-4-hydroxyphenyl)disulfide, and combinations thereof, may also be used.

It is also contemplated that alkylidenebisphenols, for example 2,2'-methylenebis(6-tert-butyl-4-methylphenol), 2,2'-methylenebis(6-tert-butyl-4-ethylphenol), 2,2'-methylenebis[4-methyl-6-(α-methylcyclohexyl)phenol], 2,2'-methylenebis(4-methyl-6-cyclohexylphenol), 2,2'-methylenebis (6-nonyl-4-methylphenol), 2,2'-methylenebis(4,6-di-tert-butylphenol), 2,2'-ethylidenebis(4,6-di-tert-butylphenol), 2,2'-ethylidenebis(6-tert-butyl-4-isobutylphenol), 2,2'-methylenebis[6-(α-methylbenzyl)-4-nonylphenol], 2,2'-methylenebis[6-(α,α-dimethylbenzyl)-4-nonylphenol], 4,4'-methylenebis(2,6-di-tert-butylphenol), 4,4'-methylenebis(6-tert-butyl-2-methylphenol), 1,1-bis(5-tert-butyl-4-hydroxy-2-methylphenyl)butane, 2,6-bis(3-tert-butyl-5-methyl-2-hydroxybenzyl)-4-methylphenol, 1,1,3-tris(5-tert-butyl-4-hydroxy-2-methylphenyl)butane, 1,1-bis(5-tert-butyl-4-hydroxy-2-methyl-phenyl)-3-n-dodecylmercapto butane, ethylene glycol bis[3,3-bis(3'-tert-butyl-4'-hydroxyphenyl) butyrate], bis(3-tert-butyl-4-hydroxy-5-methyl-phenyl)dicyclopentadiene, bis[2-(3'-tert-butyl-2'-hydroxy-5'-methylbenzyl)-6-tert-butyl-4-methylphenyl]terephthalate, 1,1-bis-(3,5-dimethyl-2-hydroxyphenyl)butane, 2,2-bis-(3,5-di-tert-butyl-4-hydroxyphenyl)propane, 2,2-bis-(5-tert-butyl-4-hydroxy-2-methylphenyl)-4-n-dodecylmercaptobutane, 1,1,5,5-tetra-(5-tert-butyl-4-hydroxy-2-methyl phenyl)pentane, and combinations thereof may be utilized as antioxidants in the lubricant composition.

O-, N- and S-benzyl compounds, for example 3,5,3',5'-tetra-tert-butyl-4,4'-dihydroxydibenzyl ether, octadecyl-4-hydroxy-3,5-dimethylbenzylmercaptoacetate, tris-(3,5-di-tert-butyl-4-hydroxybenzyl)amine, bis(4-tert-butyl-3-hydroxy-2,6-dimethylbenzyl)dithiol terephthalate, bis(3,5-di-tert-butyl-4-hydroxybenzyl)sulfide, isooctyl-3,5di-tert-butyl-4-hydroxy benzylmercaptoacetate, and combinations thereof, may also be utilized.

Hydroxybenzylated malonates, for example dioctadecyl-2,2-bis-(3,5-di-tert-butyl-2-hydroxybenzyl)-malonate, di-octadecyl-2-(3-tert-butyl-4-hydroxy-5-methylbenzyl)-malonate, di-dodecylmercaptoethyl-2,2-bis-(3,5-di-tert-butyl-4-hydroxybenzyl)malonate, bis[4-(1,1,3,3-tetramethylbutyl)phenyl]-2,2-bis(3,5-di-tert-butyl-4-hydroxybenzyl) malonate, and combinations thereof are also suitable for use as antioxidants.

Triazine compounds, for example 2,4-bis(octylmercapto)-6-(3,5-di-tert-butyl-4-hydroxyanilino)-1,3,5-triazine, 2-octylmercapto-4,6-bis(3,5-di-tert-butyl-4-hydroxyanilino)-1,3,5-triazine, 2-octylmercapto-4,6-bis(3,5-di-tert-butyl-4-hydroxyphenoxy)-1,3,5-triazine, 2,4,6-tris(3,5-di-tert-butyl-4-hydroxyphenoxy)-1,2,3-triazine, 1,3,5-tris(3,5-di-tert-butyl-4-hydroxybenzyl)isocyanurate, 1,3,5-tris(4-tert-butyl-3-hydroxy-2,6-dimethylbenzyl 2,4,6-tris(3,5-di-tert-butyl-4-hydroxyphenylethyl)-1,3,5-triazine, 1,3,5-tris(3,5-di-tert-butyl-4-hydroxyphenyl propionyl)-hexahydro-1,3,5-triazine, 1,3,5-tris-(3,5-dicyclohexyl-4-hydroxybenzyl)-isocyanurate, and combinations thereof, may also be used.

Additional examples of antioxidants include aromatic hydroxybenzyl compounds, for example, 1,3,5-tris-(3,5-di-tert-butyl-4-hydroxybenzyl)-2,4,6-trimethylbenzene, 1,4-bis (3,5-di-tert-butyl-4-hydroxybenzyl)-2,3,5,6-tetramethylbenzene, 2,4,6-tris(3,5-di-tert-butyl-4-hydroxybenzyl)phenol, and combinations thereof. Benzylphosphonates, for example dimethyl-2,5-di-tert-butyl-4-hydroxybenzylphosphonate, diethyl-3,5-di-tert-butyl-4-hydroxybenzylphosphonate, dioctadecyl 3,5-di-tert-butyl-4-hydroxybenzylphosphonate, dioctadecyl-5-tert-butyl-4-hydroxy-3-methylbenzylphosphonate, the calcium salt of the monoethyl ester of 3,5-di-tert-butyl-4-hydroxybenzylphosphonic acid, and combinations thereof, may also be utilized. In addition, acylaminophenols, for example 4-hydroxylauranilide, 4-hydroxystearanilide, and octyl N-(3,5-di-tert-butyl-4-hydroxyphenyl)carbamate.

Esters of [3-(3,5-di-tert-butyl-4-hydroxyphenyl)propionic acid with mono- or polyhydric alcohols, e.g. with methanol, ethanol, octadecanol, 1,6-hexanediol, 1,9-nonanediol, ethylene glycol, 1,2-propanediol, neopentyl glycol, thiodiethylene glycol, diethylene glycol, triethylene glycol, pentaerythritol, tris(hydroxyethyl)isocyanurate, N,N'-bis(hydroxyethyl)oxamide, 3-thiaundecanol, 3-thiapentadecanol, trimethylhexanediol, trimethylolpropane, 4-hydroxymethyl-1-phospha-2,6,7-trioxabicyclo[2.2.2]octane, and combinations thereof, may also be used. It is further contemplated that esters of β-(5-tert-butyl-4-hydroxy-3-methylphenyl)-propionic acid with mono- or polyhydric alcohols, e.g. with methanol, ethanol, octadecanol, 1,6-hexanediol, 1,9-nonanediol, ethylene glycol, 1,2-propanediol, neopentyl glycol, thiodiethylene glycol, diethylene glycol, triethylene glycol, pentaerythritol, tris(hydroxyethyl)isocyanurate, N,N'-bis(hydroxyethyl)oxamide, 3-thiaundecanol, 3-thiapentadecanol, trimethylhexanediol, trimethylolpropane, 4-hydroxymethyl-1-phospha-2,6,7-trioxabicyclo[2.2.2]octane, and combinations thereof, may be used.

Additional examples of suitable antioxidants include those that include nitrogen, such as amides of β-(3,5-di-tert-butyl-4-hydroxyphenyl)propionic acid, e.g., N,N-bis(3,5-di-tert-butyl-4-hydroxyphenylpropionyl)hexamethylenediamine, N,N'-bis(3,5-di-tert-butyl-4-hydroxyphenyl-propionyl)trimethylenediamine, N,N'-bis(3,5-di-tert-butyl-4-hydroxyphenylpropionyl)hydrazine. Other suitable examples of antioxidants include aminic antioxidants such as N,N'-diisopropyl-p-phenylenediamine, N,N'-di-sec-butyl-p-phenylenediamine, N,N'-bis(1,4-dimethylpentyl)-p-phenylenediamine, N,N'-bis(1-ethyl-3-methylpentyl)-p-phenylenediamine, N,N'-bis(1-methylheptyl)-p-phenylenediamine, N,N'-dicyclohexyl-p-phenylenediamine, N,N'-diphenyl-p-phenylenediamine, N,N'-bis(2-naphthyl)-p-phenylenediamine, N-isopropyl-N'-phenyl-p-phenylenediamine, N-(1,3-dimethyl-butyl)-N'-phenyl-p-phenylenediamine, N-(1-methylheptyl)-N'-phenyl-p-phenylenediamine, N-cyclohexyl-N'-phenyl-p-phenylenediamine, 4-(p-toluenesulfamoyl)diphenylamine, N,N'-dimethyl-N,N'-di-sec-butyl-p-phenylenediamine, diphenylamine, N-allyldiphenylamine, 4-isopropoxydiphenylamine, N-phenyl-1-naphthylamine, N-phenyl-2-naphthylamine, octylated diphenylamine, for example p,p'-di-tert-octyldiphenylamine, 4-n-butylaminophenol, 4-butyrylaminophenol, 4-nonanoylaminophenol, 4-dodecanoylaminophenol, 4-octadecanoylaminophenol, bis(4-methoxyphenyl)amine, 2,6-di-tert-butyl-4-dimethylamino methylphenol, 2,4'- diaminodiphenylmethane, 4,4'-diaminodiphenylmethane, N,N,N',N'-tetramethyl-4,4'-diaminodiphenylmethane, 1,2-bis[(2-methyl-phenyl)amino]ethane, 1,2-bis(phenylamino) propane, (o-tolyl)biguanide, bis[4-(1',3'-dimethylbutyl)phenyl]amine, tert-octylated N-phenyl-1-naphthylamine, a mixture of mono- and dialkylated tert-butyl/tert-octyldiphenylamines, a mixture of mono- and dialkylated isopropyl/isohexyldiphenylamines, mixtures of mono- and dialkylated tert-butyldiphenylamines, 2,3-dihydro-3,3-dimethyl-4H-1,4-benzothiazine, phenothiazine, N-allylphenothiazine, N,N,N',N'-tetraphenyl-1,4-diaminobut-2-ene, and combinations thereof.

Even further examples of suitable antioxidants include aliphatic or aromatic phosphites, esters of thiodipropionic acid or of thiodiacetic acid, or salts of dithiocarbamic or dithiophosphoric acid, 2,2,12,12-tetramethyl-5,9-dihydroxy-3,7,1trithiamidecane and 2,2,15,15-tetramethyl-5,12-dihydroxy-3,7,10,14-tetrathiahexadecane, and combinations thereof. Furthermore, sulfurized fatty esters, sulfurized fats and sulfurized olefins, and combinations thereof, may be used.

If employed, the antioxidant can be used in various amounts. The antioxidant may be present in the lubricant composition in an amount of from 0.01 to 5, 0.1 to 3, or 0.5 to 2, wt. %, based on the total weight of the lubricant composition. Alternatively, the antioxidant may be present in amounts of less than 5, less than 3, or less than 2, wt. %, based on the total weight of the lubricant composition.

If employed, the metal deactivator can be of various types. Suitable metal deactivators include benzotriazoles and derivatives thereof, for example 4- or 5 alkylbenzotriazoles (e.g. tolutriazole) and derivatives thereof, 4,5,6,7-tetrahydrobenzotriazole and 5,5'-methylenebisbenzotriazole; Mannich bases of benzotriazole or tolutriazole, e.g. 1-[bis(2-ethylhexyl)aminomethyl)tolutriazole and 1-[bis(2-ethylhexyl) aminomethyl)benzotriazole; and alkoxyalkylbenzotriazoles such as 1-(nonyloxymethyl)benzotriazole, 1-(1-butoxyethyl) benzotriazole and 1-(1-cyclohexyloxybutyl)tolutriazole, and combinations thereof.

Additional examples of suitable metal deactivators include 1,2,4-triazoles and derivatives thereof, and Mannich bases of 1,2,4-triazoles, such as 1-[bis(2-ethylhexyl)aminomethyl-1,2,4-triazole; alkoxyalkyl-1,2,4-triazoles such as 1-(1-butoxyethyl)-1,2,4-triazole; and acylated 3-amino-1,2,4-triazoles, imidazole derivatives, for example 4,4'-methylenebis(2-undecyl-5-methylimidazole) and bis[(N-methyl)imidazol-2-yl] carbinol octyl ether, and combinations thereof. Further examples of suitable metal deactivators include sulfur-containing heterocyclic compounds, for example 2-mercaptobenzothiazole, 2,5-dimercapto-1,3,4-thiadiazole and derivatives thereof; and 3,5-bis[di(2-ethylhexyl)aminomethyl]-1,3,4-thiadiazolin-2-one, and combinations thereof. Even further examples of metal deactivators include amino compounds, for example salicylidenepropylenediamine, salicylaminoguanidine and salts thereof, and combinations thereof.

If employed, the metal deactivator can be used in various amounts. The metal deactivator may be present in the lubricant composition in an amount of from 0.01 to 0.1, 0.05 to 0.01, or 0.07 to 0.1, wt. %, based on the total weight of the lubricant composition. Alternatively, the metal deactivator may be present in amounts of less than 1.0, less than 0.7, or less than 0.5, wt. %, based on the total weight of the lubricant composition.

If employed, the rust inhibitor and/or friction modifier can be of various types. Suitable examples of rust inhibitors and/or friction modifiers include organic acids, their esters, metal salts, for example alkyl- and alkenylsuccinic acids and their partial esters with alcohols, diols or hydroxycarboxylic acids, partial amides of alkyl- and alkenylsuccinic acids, 4-nonylphenoxyacetic acid, alkoxy- and alkoxyethoxycarboxylic acids such as dodecyloxyacetic acid, dodecyloxy(ethoxy) acetic acid, and also N-oleoylsarcosine, sorbitan monooleate, lead naphthenate, alkenylsuccinic anhydrides, for example, dodecenylsuccinic anhydride, 2-carboxymethyl-1-dodecyl-3-methylglycerol, and combinations thereof. Further examples include heterocyclic compounds, for example: substituted imidazolines and oxazolines, and 2-heptadecenyl-1-(2-hydroxyethyl)imidazoline, phosphorus-containing compounds, for example: amine salts of phosphoric acid partial esters or phosphonic acid partial esters, molybdenum-containing compounds, such as molydbenum dithiocarbamate and other sulphur and phosphorus containing derivatives, sulfur-containing compounds, for example: barium dinonylnaphthalenesulfonates, calcium petroleum sulfonates, alkylthio-substituted aliphatic carboxylic acids, esters of aliphatic 2-sulfocarboxylic acids and salts thereof, glycerol derivatives, for example: glycerol monooleate, 1-(alkylphenoxy)-3-(2-hydroxyethyl)glycerols, 1-(alkylphenoxy)-3-(2,3-dihydroxypropyl)glycerols and 2-carboxyalkyl-1,3-dialkylglycerols, and combinations thereof.

If employed, the rust inhibitor and/or friction modifier can be used in various amounts. The rust inhibitor and/or friction modifier may be present in the lubricant composition in an amount of from 0.01 to 0.1, 0.05 to 0.01, or 0.07 to 0.1, wt. %, based on the total weight of the lubricant composition. Alternatively, the rust inhibitor and/or friction modifier may be present in amounts of less than 1, less than 0.7, or less than 0.5, wt. %, based on the total weight of the lubricant composition.

If employed, the viscosity index improver can be of various types. Suitable examples of viscosity index improvers include polyacrylates, polymethacrylates, vinylpyrrolidone/methacrylate copolymers, polyvinylpyrrolidones, polybutenes, olefin copolymers, styrene/acrylate copolymers and polyethers, and combinations thereof.

If employed, the viscosity index improver can be used in various amounts. The viscosity index improver may be present in the lubricant composition in an amount of from 0.01 to 20, 1 to 15, or 1 to 10, wt. %, based on the total weight of the lubricant composition. Alternatively, the viscosity index improver may be present in amounts of less than 10, less than 8, or less than 5, wt. %, based on the total weight of the lubricant composition.

If employed, the pour point depressant can be of various types. Suitable examples of pour point depressants include polymethacrylate and alkylated naphthalene derivatives, and combinations thereof.

If employed, the pour point depressant can be used in various amounts. The pour point depressant may be present in the lubricant composition in an amount of from 0.01 to 0.1, 0.05 to 0.01, or 0.07 to 0.1, wt. %, each based on the total weight of the lubricant composition. Alternatively, the pour point depressant may be present in amounts of less than 1.0, less than 0.7, or less than 0.5, wt. %, based on the total weight of the lubricant composition.

If employed, the detergent can be of various types. Suitable examples of detergents include overbased or neutral metal sulphonates, phenates and salicylates, and combinations thereof.

If employed, the detergent can be used in various amounts. The detergent may be present in the lubricant composition in an amount of from 0.01 to 5, 0.1 to 4, 0.5 to 3, or 1 to 3, wt. %, based on the total weight of the lubricant composition. Alternatively, the detergent may be present in amounts of less than 5, less than 4, less than 3, less than 2, or less than 1, wt. %, based on the total weight of the lubricant composition.

Preferred lubricant compositions provided for use and used pursuant to this invention include those which pass the CEC L-39-T96 seal compatibility test. The CEC L-39-T96 test involves keeping a test specimen of a fluoropolymer in a lubricant composition at 150° C. The seal specimens are then removed and dried and the properties of the seal specimens are assessed and compared to the seal specimens which were not heated in the lubricant composition. The percent change in these properties is assessed to quantify the compatibility of the fluoropolymer seal with the lubricant composition. The incorporation of the epoxide compound into the lubricant composition decreases the tendency of the lubricant composition to degrade the seals versus lubricant compositions which are free from the epoxide compound.

The pass/fail criteria include maximum variation of certain characteristics after immersion for 7 days in fresh oil without pre-aging. The maximum variation for each characteristic depends on the type of elastomer used, the type of engine used, and whether an aftertreatment device is utilized.

The characteristics measured before and after immersion included Hardness DIDC (points); Tensile Strength (%); Elongation at Rupture (%); Volume Variation (%). For heavy-duty diesel engines, the pass/fail criteria are presented below in Table 1:

TABLE 1

Fluoropolymer Seal Compatibility for CEC L-39-T96 Heavy-Duty Diesel Engines

| Property | Elastomer Type RE1 |
|---|---|
| Hardness DIDC, points | −1/+5 |
| Tensile Strength, % | −50/+10 |
| Elongation at Rupture, % | −60/+10 |
| Volume Variation, % | −1/+5 |

In these tests, a conventional lubricant composition passes the test if the exposed test specimen exhibits a change in hardness from −1% to +5%; a tensile strength (as compared to an untested specimen) from −50% to +10%; a change in elongation at rupture (as compared to an untested specimen) from −60% to +10%; and a volume variation (as compared to an untested specimen) from −1% to +5%.

When the lubricant composition is tested according to CEC L-39-T96 for Heavy-Duty Diesel Engines, the change in hardness can range from −1 to 5%, −0.5 to 5%, −0.1 to 5%, 0.5 to 5%, or 1 to 5%; the change in tensile strength can range from −50 to 10%, −45 to 10%, −40 to 10%, or −35 to 10%; the change in elongation at rupture can range from −60 to 10%, −55 to 10%, −50 to 10%, or −45 to 10%; and the change in volume variation can range from −1 to 5%, −0.75 to 5%, −0.5 to 5%, −0.1 to 5%, or 0 to 5%.

When the epoxide composition is used in the lubricant compositions described, the resulting lubricant composition has a fluoropolymer compatibility such that a fluoropolymer seal submerged in the lubricant composition exhibits a change in tensile strength of less than 10, less than 15, less than 20, less than 25, less than 30, less than 35, less than 40, less than 45, less than 50, less than 55, or less than 60, %, when tested according to CEC L-39-T96 for Heavy-Duty Diesel Engines. Similarly, when the epoxide compound is used in the lubricant compositions described, the resulting lubricant composition has a fluoropolymer compatibility such that a fluoropolymer exhibits a change in elongation at rupture of less than 20, less than 25, less than 30, less than 35, less than 40, less than 45, less than 50, less than 55, or less than 60, %, when tested according to CEC L-39-T96 for Heavy-Duty Diesel Engines.

Some of the compounds described above may interact in the lubricant composition, so that the components of the lubricant composition in final form may be different from those components that are initially added or combined together. Some products formed thereby, including products formed upon employing the lubricant composition of this invention in its intended use, are not easily described or describable. Nevertheless, all such modifications, reaction products, and products formed upon employing the lubricant composition of this invention in its intended use, are expressly contemplated and hereby included herein. Various embodiments of this invention include one or more of the modification, reaction products, and products formed from employing the lubricant composition, as described above.

A method of lubricating a system is provided. The method includes contacting the system with the lubricant composition described above. The system may further include an internal combustion engine. Alternatively, the system may further include any combustion engine or application that utilizes a lubricant composition. The system includes at least one fluoropolymer seal.

The method may include providing the lubricant composition to the crankcase of the internal combustion engine, providing a fuel in a combustion chamber of the internal combustion engine, and combusting the fuel in an internal combustion engine.

The fluoropolymer seal may include a fluoroelastomer. The fluoroelastomer may be categorized under ASTM D1418 and ISO 1629 designation of FKM for example. The fluoroelastomer may include copolymers of hexafluoropropylene (HFP) and vinylidene fluoride (VDF of VF2), terpolymers of tetrafluoroethylene (TFE), vinylidene fluoride and hexafluoropropylene, perfluoromethylvinylether (PMVE), copolymers of TFE and propylene and copolymers of TFE, PMVE and ethylene. The fluorine content varies for example between 66 to 70 wt. %, based on the total weight of the fluoropolymer seal. FKM is fluoro-rubber of the polymethylene type having substituent fluoro and perfluoroalkyl or perfluoroalkoxy groups on the polymer chain.

In addition, a method of forming the lubricant composition is provided. The method includes combining the base oil and the epoxide compound, and, optionally, the amine compound and/or the antiwear additive. The epoxide compound may be incorporated into the base oil in any convenient way. Thus, the epoxide compound can be added directly to the base oil by dispersing or dissolving it in the base oil at the desired level of concentration. Alternatively, the base oil may be added directly to the epoxide compound in conjunction with agitation until the epoxide compound is provided at the desired level of concentration. Such blending may occur at ambient or lower temperatures, such as 30, 25, 20, 15, 10, or 5° C.

EXAMPLES

Without being limited, in the below examples, exemplary lubricant compositions were formulated by blending each of the components together until homogeneity was achieved. A partially formulated lubricant composition containing dispersant, detergent, aminic antioxidant, phenolic antioxidant, anti-foam, base oil, pour point depressant and viscosity modifier was prepared. This lubricant composition, which is representative of a commercial crankcase lubricant, is designated as the "reference lubricant" and used as a baseline to demonstrate the effects of the epoxide compound on TBN and seal compatibility.

The reference lubricant was combined with various different epoxide compounds to demonstrate the effect of the epoxide compound on TBN and seal compatibility. Other components were combined with the reference lubricant in combination with the epoxide compound to demonstrate synergies between the epoxide compound and these other components with respect to TBN and seal compatibility.

The epoxide compound used in examples 5-10, 15, and 31-34 is 3,4-epoxycyclohexylmethyl-3,4-epoxycyclohexane carboxylate. The epoxide compound used in example 16 is 1,4-butanediol diglycidyl ether. The epoxide compound used in example 17 is 1,2,7,8-diepoxyoctane. The epoxide compound used in examples 18 and 22 is glycidol. The epoxide compound used in examples 19 and 23 is N-tert-butyl-2,3-epoxypropionamide. The epoxide compound used in examples 20 and 24 is N-isopropyl-2,3-epoxypropionamide. The epoxide compound used in examples 21 and 25 is n-butyl-2,3-epoxy propionate.

The amine compound used in examples 8, 9, 11, 22-25, 27, and 31 is (2,2,6,6-tetramethyl-4-piperidyl)dodecanoate. The amine compound used in examples 12, 28, and 32 is (1,2,2,6,6-pentamethyl-4-piperidyl)dodecanoate. The amine compound used in examples 13, 29, and 33 is 1-dodecylamine. The amine compound used in examples 14, 30, and 34 is Infineum C9232 (a 950 MW PIPSA-PAM dispersant).

The antiwear additive used in examples 2, 5, and 8 is Infineum C9417 (a mixed primary/secondary dihydrocarbyldithiophosphate salt. The antiwear additive used in examples 3, 6, and 15-34 is HiTEC 7169 (a secondary dithiodihydrocarbylphosphate salt). The antiwear additive used in examples 4, 7, and 9 is ELCO 108 (a primary dithiodihydrocarbyldiphosphate salt).

The respective amount of the reference lubricant and any additional components for each of the examples are shown in Tables 2-7 below:

TABLE 2

Formulations of Examples #1-#7

| | Example # | | | | | | |
|---|---|---|---|---|---|---|---|
| | 1 | 2 | 3 | 4 | 5 | 6 | 7 |
| Reference Lubricant (g) | 80 | 80 | 80 | 80 | 80 | 80 | 80 |
| Additional Base Oil (g) | 20 | 18.87 | 18.87 | 18.87 | 18.37 | 18.37 | 18.37 |
| Epoxide Compound (g) | 0 | 0 | 0 | 0 | 0.50 | 0.50 | 0.50 |
| Practical Amine Compound (g) | 0 | 0 | 0 | 0 | 0 | 0 | 0 |
| Antiwear Additive (g) | 0 | 1.13 | 1.13 | 1.13 | 1.13 | 1.13 | 1.13 |
| Total Weight (g) | 100 | 100 | 100 | 100 | 100 | 100 | 100 |

TABLE 3

Formulations of Examples #8-#14

| | Example # | | | | | | |
|---|---|---|---|---|---|---|---|
| | 8 | 9 | 10 | 11 | 12 | 13 | 14 |
| Reference Lubricant (g) | 80 | 80 | 80 | 80 | 80 | 80 | 80 |
| Additional Base Oil (g) | 17.17 | 17.17 | 19.5 | 18.8 | 18.72 | 19.32 | 14.29 |
| Epoxide Compound (g) | 0.50 | 0.50 | 0.50 | 0 | 0 | 0 | 0 |
| Amine Compound (g) | 1.20 | 1.20 | 0 | 1.20 | 1.29 | 0.68 | 5.71 |
| Antiwear Additive (g) | 1.13 | 1.13 | 0 | 0 | 0 | 0 | 0 |
| Total Weight (g) | 100 | 100 | 100 | 100 | 100 | 100 | 100 |

TABLE 4

Formulations of Examples #15-#21

| | Example # | | | | | | |
|---|---|---|---|---|---|---|---|
| | 15 | 16 | 17 | 18 | 19 | 20 | 21 |
| Reference Lubricant (g) | 80 | 80 | 80 | 80 | 80 | 80 | 80 |
| Additional Base Oil (g) | 18.37 | 18.47 | 18.59 | 18.58 | 18.30 | 18.36 | 18.30 |
| Epoxide Compound (g) | 0.50 | 0.40 | 0.28 | 0.29 | 0.57 | 0.51 | 0.57 |
| Amine Compound (g) | 0 | 0 | 0 | 0 | 0 | 0 | 0 |
| Antiwear Additive (g) | 1.13 | 1.13 | 1.13 | 1.13 | 1.13 | 1.13 | 1.13 |
| Total Weight (g) | 100 | 100 | 100 | 100 | 100 | 100 | 100 |

TABLE 5

| Formulations of Examples #22-25 | | | | |
|---|---|---|---|---|
| | Example # | | | |
| | 22 | 23 | 24 | 25 |
| Reference Lubricant (g) | 80 | 80 | 80 | 80 |
| Additional Base Oil (g) | 17.38 | 17.10 | 17.16 | 17.10 |
| Epoxide Compound (g) | 0.29 | 0.57 | 0.51 | 0.57 |
| Amine Compound (g) | 1.20 | 1.20 | 1.2 | 1.20 |
| Antiwear Additive (g) | 1.13 | 1.13 | 1.13 | 1.13 |
| Total Weight (g) | 100 | 100 | 100 | 100 |

TABLE 6

| Formulations of Examples #26-#30 | | | | | |
|---|---|---|---|---|---|
| | Example # | | | | |
| | 26 | 27 | 28 | 29 | 30 |
| Reference Lubricant (g) | 80 | 80 | 80 | 80 | 80 |
| Additional Base Oil (g) | 18.87 | 17.67 | 17.59 | 18.19 | 13.16 |
| Epoxide Compound (g) | 0 | 0 | 0 | 0 | 0 |
| Amine Compound (g) | 0 | 1.2 | 1.29 | 0.68 | 5.71 |
| Antiwear Additive (g) | 1.13 | 1.13 | 1.13 | 1.13 | 1.13 |
| Total Weight (g) | 100 | 100 | 100 | 100 | 100 |

TABLE 7

| Formulations of Examples #31-#34 | | | | |
|---|---|---|---|---|
| | Example # | | | |
| | 31 | 32 | 33 | 34 |
| Reference Lubricant (g) | 80 | 80 | 80 | 80 |
| Additional Base Oil (g) | 17.17 | 17.09 | 17.69 | 12.66 |
| Epoxide Compound (g) | 0.50 | 0.50 | 0.50 | 0.50 |
| Amine Compound (g) | 1.20 | 1.29 | 0.68 | 5.71 |
| Antiwear Additive (g) | 1.13 | 1.13 | 1.13 | 1.13 |
| Total Weight (g) | 100 | 100 | 100 | 100 |

The TBN of the exemplary lubricant compositions were tested according to ASTM D2896 and ASTM D4739. These test methods can be used to indicate relative changes that occur in the lubricant composition during use under oxidizing or other service conditions regardless of the color or other properties of the resulting lubricant composition.

The seal compatibility of the exemplary lubricant compositions were tested according to the industry-standard CEC L-39-T96 seal compatibility test. The CEC-L-39-T96 seal compatibility test is performed by submitting the seal or gaskets in the lubricant composition, heating the lubricant composition with the seal contained therein to an elevated temperature, and maintaining the elevated temperature for a period of time. The seals are then removed and dried, and the mechanical properties of the seal are assessed and compared to the seal specimens which were not heated in the lubricant composition. The percent change in these properties is analyzed to assess the compatibility of the seal with the lubricant composition.

The results of the TBN and seal compatibility tests are shown below in Tables 8-13:

TABLE 8

| TBN and Seal Compatibility Test Results - Examples #1-#7 | | | | | | | |
|---|---|---|---|---|---|---|---|
| | Example # | | | | | | |
| | 1 | 2 | 3 | 4 | 5 | 6 | 7 |
| Volume Change (%) | 0.4 | 0.6 | 0.4 | 0.4 | 0.5 | 0.5 | 0.5 |
| Points Hardness DIDC | 3 | 0 | 1 | 1 | 1 | 1 | 1 |
| Tensile Strength (%) | −23 | −9 | −6 | −6 | −7 | −12 | −8 |
| Elongation at Rupture (%) | −47 | −40 | −27 | −24 | −22 | −27 | −23 |
| TBN by ASTM D4739 (mg KOH/g) | 9.16 | 9.05 | 9.01 | 9.42 | 9.80 | 9.37 | 9.43 |
| TBN by ASTM D 2896 (mg KOH/g) | 12.18 | 12.12 | 12.04 | 12.23 | 13.80 | 13.56 | 14.38 |

TABLE 9

| TBN and Seal Compatibility Test Results - Examples #8-#14 | | | | | | | |
|---|---|---|---|---|---|---|---|
| | Example # | | | | | | |
| | 8 | 9 | 10 | 11 | 12 | 13 | 14 |
| Volume Change (%) | 0.9 | 1 | 1.5 | 0.7 | 0.7 | 21 | 0.3 |
| Points Hardness DIDC | 3 | 2 | 2 | 4 | 4 | 12 | 4 |
| Tensile Strength (%) | −23 | −17 | −7 | −24 | −23 | −66 | −28 |
| Elongation at Rupture (%) | −42 | −33 | −45 | −50 | −49 | −72 | −49 |
| TBN by ASTM D4739 (mg KOH/g) | 11.28 | 11.53 | 9.02 | 10.94 | 10.99 | 11.21 | 10.94 |
| TBN by ASTM D 2896 (mg KOH/g) | 15.34 | 16.42 | 14.00 | 13.14 | 13.12 | 13.91 | 14.76 |

TABLE 10

TBN and Seal Compatibility Test Results - Examples #15-#21

| | Example # | | | | | | |
|---|---|---|---|---|---|---|---|
| | 15 | 16 | 17 | 18 | 19 | 20 | 21 |
| Volume Change (%) | 0.5 | 0.6 | 0.6 | 0.4 | 0.6 | 0.8 | 0.5 |
| Points Hardness DIDC | 0 | −1 | −1 | 0 | 1 | 2 | 0 |
| Tensile Strength (%) | 5 | 2 | 3 | 2 | −4 | −12 | 8 |
| Elongation at Rupture (%) | −19 | −20 | −4 | −9 | −23 | −30 | −4 |
| TBN by ASTM D4739 (mg KOH/g) | 9.37 | 9.18 | 9.12 | 9.49 | 9.22 | 9.45 | 9.12 |
| TBN by ASTM D 2896 (mg KOH/g) | 12.97 | 12.14 | 12.51 | 12.96 | 12.51 | 12.48 | 12.59 |

TABLE 11

TBN and Seal Compatibility Test Results - Examples #22-#25

| | Example # | | | |
|---|---|---|---|---|
| | 22 | 23 | 24 | 25 |
| Volume Change (%) | 0.7 | 0.9 | 0.9 | 0.8 |
| Points Hardness DIDC | 0 | 2 | 3 | 1 |
| Tensile Strength (%) | −9 | −24 | −32 | −13 |
| Elongation at Rupture (%) | −18 | −46 | −54 | −32 |
| TBN by ASTM D4739 (mg KOH/g) | 11.66 | 11.21 | 10.99 | 11.42 |
| TBN by ASTM D 2896 (mg KOH/g) | 14.67 | 14.66 | 14.75 | 14.55 |

TABLE 12

TBN and Seal Compatibility Test Results - Examples #26-#30

| | Example # | | | | |
|---|---|---|---|---|---|
| | 26 | 27 | 28 | 29 | 30 |
| Volume Change (%) | 0.4 | 0.9 | 1 | 5.7 | 0.6 |
| Points Hardness DIDC | 0 | 3 | 3 | 14 | 4 |
| Tensile Strength (%) | −3 | −13 | −14 | −67 | −27 |
| Elongation at Rupture (%) | −21 | −52 | −55 | −78 | −53 |
| TBN by ASTM D4739 (mg KOH/g) | 8.63 | 9.81 | 10.36 | 10.24 | 10.40 |
| TBN by ASTM D 2896 (mg KOH/g) | 11.64 | 13.15 | 13.38 | 13.04 | 14.55 |

TABLE 13

TBN and Seal Compatibility Test Results - Examples #31-#34

| | Example # | | | |
|---|---|---|---|---|
| | 31 | 32 | 33 | 34 |
| Volume Change (%) | 0.8 | 0.7 | 8.1 | 0.6 |
| Points Hardness DIDC | 0 | 0 | 12 | 3 |
| Tensile Strength (%) | −6 | −3 | −66 | −26 |
| Elongation at Rupture (%) | −23 | −19 | −75 | −53 |
| TBN by ASTM D4739 (mg KOH/g) | 10.84 | 10.93 | 10.85 | 11.08 |
| TBN by ASTM D 2896 (mg KOH/g) | 14.98 | 15.15 | 15.02 | 16.45 |

These examples demonstrate that the epoxide compound improves the TBN and seal compatibility of a lubricant composition. For example, the examples demonstrate that lubricant compositions that include the epoxide compound demonstrate improved TBN, according to ASTM D4739 and/or ASTM D2896, even when combined with components that would not ordinarily be expected to affect, or significantly affect, the TBN of the lubricant composition. Furthermore, the examples demonstrate that lubricant compositions which include the epoxide compound demonstrate improved seal compatibility in terms of in terms of volume change, points hardness, tensile strength and/or elongation at rupture, even when combined with components that would ordinary be expected to negatively affect the seal compatibility of the lubricant composition in a significant way. In summary, lubricant compositions that include the epoxide compound demonstrate superior results when compared to lubricant compositions that do not include the epoxide compound It is to be understood that the appended claims are not limited to express and particular compounds, compositions, or methods described in the detailed description, which may vary between particular embodiments that fall within the scope of the appended claims. With respect to any Markush groups relied upon herein for describing particular features or aspects of various embodiments, it is to be appreciated that different, special, and/or unexpected results may be obtained from each member of the respective Markush group independent from all other Markush members. Each member of a Markush group may be relied upon individually and/or in combination and provides adequate support for specific embodiments within the scope of the appended claims.

It is also to be understood that any ranges and subranges relied upon in describing various embodiments of the present invention independently and collectively fall within the scope of the appended claims and are understood to describe and contemplate all ranges, including whole and/or fractional values therein, even if such values are not expressly written herein. One of skill in the art readily recognizes that the enumerated ranges and subranges sufficiently describe and enable various embodiments of the present invention and such ranges and subranges may be further delineated into relevant halves, thirds, quarters, fifths, and so on. As just one example, a range "of from 0.1 to 0.9" may be further delineated into a lower third, i.e., from 0.1 to 0.3, a middle third, i.e., from 0.4 to 0.6, and an upper third, i.e., from 0.7 to 0.9, which individually and collectively are within the scope of the appended claims and may be relied upon individually and/or collectively and provide adequate support for specific embodiments within the scope of the appended claims.

In addition, with respect to the language which defines or modifies a range, such as "at least," "greater than," "less than," "no more than," and the like, it is to be understood that such language includes subranges and/or an upper or lower limit. As another example, a range of "at least 10" inherently includes a subrange of from at least 10 to 35, a subrange of from at least 10 to 25, a subrange from 25 to 35, and so on, and each subrange may be relied upon individually and/or collectively and provides adequate support for specific embodiments within the scope of the appended claims. Finally, an individual number within a disclosed range may be relied upon and provides adequate support for specific embodiments within the scope of the appended claims. For example, a range "of from 1 to 9" includes various individual integers, such as 3, as well as individual numbers including a decimal point (or fraction), such as 4.1, which may be relied upon and provide adequate support for specific embodiments within the scope of the appended claims.

The invention has been described in an illustrative manner and it is to be understood that the terminology which has been used is intended to be in the nature of words of description rather than of limitation. Many modifications and variations of the present invention are possible in light of the above teachings and the invention may be practiced otherwise than as specifically described.

The invention claimed is:

1. A lubricant composition comprising:

a base oil included in said lubricant composition in an amount of greater than 70 wt. % based on a total weight of said lubricant composition, wherein said base oil has a viscosity of from 1 to 20 cSt when tested at 100° C. according to ASTM D445, and wherein said base oil is selected from the group of API Group I base oils, API Group II base oils, API Group III base oils, and combinations thereof;

an epoxide compound included in said lubricant composition in an amount of from 0.3 to 1.2 wt. % based on the total weight of said lubricant composition, said epoxide compound having the formula:

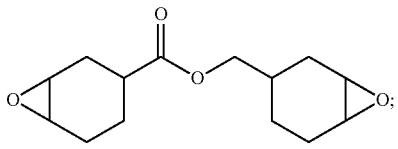

and an amine compound included in said lubricant composition in an amount of from 1 to 3 wt. % based on the total weight of said lubricant composition, said amine compound having the general formula:

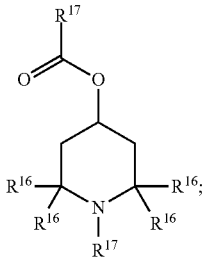

wherein each $R^{16}$ is independently a hydrogen atom or an alkyl group having from 1 to 17 carbon atoms, wherein at least three groups designated by $R^{16}$ are each an alkyl group; and wherein each $R^{17}$ is independently a hydrogen atom or an alkyl group having from 1 to 17 carbon atoms.

2. The lubricant composition of claim 1 wherein at least 50 wt. % of said epoxide compound remains unreacted in said lubricant composition based on a total weight of said epoxide compound utilized to form said lubricant composition prior to any reaction in said lubricant composition.

3. The lubricant composition of claim 1 wherein said amine compound is (2,2,6,6-tetramethyl-4-piperidyl) dodecanoate.

4. The lubricant composition of claim 1 further comprising an antiwear additive comprising phosphorous included in said lubricant composition in an amount of from 0.1 to 5 wt. % based on a total weight of said lubricant composition.

5. The lubricant composition of claim 1 further comprising a dispersant included in said lubricant composition in an amount of from 0.01 to 15 wt. % based on a total weight of said lubricant composition.

6. The lubricant composition of claim 1 wherein said lubricant composition has a fluoropolymer seal compatibility such that a fluoropolymer seal submerged in said lubricant composition exhibits a change in tensile strength of from −50 to 10% when tested according to CEC L-39-T96.

7. The lubricant composition of claim 1 wherein said lubricant composition has a fluoropolymer seal compatibility such that a fluoropolymer seal submerged in said lubricant composition exhibits a change in elongation at rupture of from −60 to 10% when tested according to CEC L-39-T96.

8. The lubricant composition of claim 1 wherein said lubricant composition has a total base number of at least 3 mg KOH/g when tested according to ASTM D2896.

9. A method of lubricating a system comprising a fluoropolymer seal, said method comprising:

providing a lubricant composition comprising:

a base oil included in the lubricant composition in an amount of greater than 70 wt. % based on a total weight of the lubricant composition, wherein the base oil has a viscosity of from 1 to 20 cSt when tested at 100° C. according to ASTM D445, and wherein the base oil is selected from the group of API Group I base oils, API Group II base oils, API Group III base oils, and combinations thereof;

an epoxide compound included in the lubricant composition in an amount of from 0.3 to 1.2 wt. % based on the total weight of the lubricant composition, the epoxide compound having the formula:

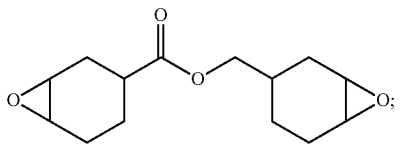

and an amine compound included in the lubricant composition in an amount of from 1 to 3 wt. % based on the total weight of the lubricant composition, the amine compound having the general formula:

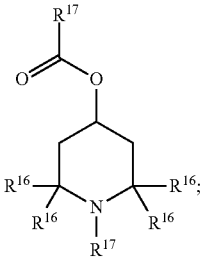

wherein each $R^{16}$ is independently a hydrogen atom or an alkyl group having from 1 to 17 carbon atoms, wherein at least three groups designated by $R^{16}$ are each an alkyl group, and wherein each $R'^{7}$ is independently a hydrogen atom or an alkyl group having from 1 to 17 carbon atoms; and contacting the fluoropolymer seal with the lubricant composition.

10. The lubricant composition of claim 4 wherein said antiwear additive comprising phosphorous is a dihydrocarbyldithiophosphate salt having the general formula (XIX):

$$[R^{21}O(R^{22}O)PS(S)]_2M \quad \text{(XIX):}$$

wherein $R^{21}$ and $R^{22}$ are each independently a hydrocarbyl groups having from 1 to 20 carbon atoms, and wherein M is a metal atom or an ammonium group.

* * * * *